US011744333B2

(12) United States Patent
Webb et al.

(10) Patent No.: US 11,744,333 B2
(45) **Date of Patent: *Sep. 5, 2023**

(54) SEGMENTED ATTACHMENT DEVICE

(71) Applicant: Apple Inc., Cupertino, CA (US)

(72) Inventors: Michael J. Webb, Scotts Valley, CA (US); Erik L. Wang, Redwood City, CA (US); Daniele De Iuliis, San Francisco, CA (US); Wayne Cowan, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 241 days.

This patent is subject to a terminal disclaimer.

(21) Appl. No.: 17/202,085

(22) Filed: Mar. 15, 2021

(65) Prior Publication Data

US 2021/0196011 A1 Jul. 1, 2021

Related U.S. Application Data

(63) Continuation of application No. 15/968,608, filed on May 1, 2018, now Pat. No. 11,000,101, which is a (Continued)

(51) Int. Cl.

*A45F 5/00* (2006.01)
*A44C 5/24* (2006.01)

(Continued)

(52) U.S. Cl.

CPC ..... *A44C 5/0007* (2013.01); *A44C 5/107* (2013.01); *A44C 5/24* (2013.01); *A45F 5/00* (2013.01);

(Continued)

(58) Field of Classification Search

CPC ..... A44C 5/00; A44C 5/0007; A44C 5/107; A44C 5/24; A45F 2005/008

See application file for complete search history.

(56) References Cited

U.S. PATENT DOCUMENTS 1,797,583 A 3/1931 Miller
1,827,243 A 10/1931 Kuehner (Continued)

FOREIGN PATENT DOCUMENTS

CH 702693 8/2011
CN 1148325 4/1997

(Continued)

OTHER PUBLICATIONS

Chinese Office Action dated Apr. 14, 2020 from Chinese Patent Application No. 201810977358.8, 22 pages including English language translation.

(Continued)

*Primary Examiner* — Brian D Nash
(74) *Attorney, Agent, or Firm* — BAKERHOSTETLER

(57) ABSTRACT

A wrist band for attaching a portable electronic device to a user includes articulating segments which may be releasably connected so as to provide the user the capability of sizing the wristband by adding or removing links as desired. A clasp is also disclosed for securing the wristband to a user. A manufacturing device and method are disclosed for machining complex surfaces on the segments and clasp.

20 Claims, 25 Drawing Sheets

Related U.S. Application Data continuation of application No. 14/820,084, filed on Aug. 6, 2015, now Pat. No. 9,980,539.

(60) Provisional application No. 62/129,956, filed on Mar. 8, 2015, provisional application No. 62/036,087, filed on Aug. 11, 2014.

(51) Int. Cl.
*A44C 5/00* (2006.01)
*G04B 37/14* (2006.01)
*A44C 5/10* (2006.01)

(52) U.S. Cl.
CPC .... *G04B 37/1486* (2013.01); *A45F 2005/008* (2013.01)

(56) References Cited

U.S. PATENT DOCUMENTS

| | | | | |
|---|---|---|---|---|
| 1,827,364 | A | 10/1931 | Johnson | |
| 1,829,675 | A | 10/1931 | Roy | |
| 1,836,955 | A | 12/1931 | Carlson | |
| 2,388,554 | A | 11/1945 | Kreisler | |
| 2,564,652 | A | 8/1951 | Templeman | |
| 2,613,415 | A | 10/1952 | Ritter | |
| 2,648,884 | A | 8/1953 | Loofboro | |
| 2,696,689 | A | 12/1954 | Speck | |
| 2,953,897 | A | 9/1960 | Pfisterer | |
| 3,726,083 | A | 4/1973 | Pompeo | |
| 3,902,313 | A | 9/1975 | Poon | |
| 4,051,668 | A | 10/1977 | Learn | |
| 4,321,734 | A | 3/1982 | Gandelman | |
| 4,638,627 | A * | 1/1987 | Wullsehleger | A44C 5/107 63/7 |
| 4,941,236 | A | 7/1990 | Sherman | |
| 5,323,516 | A | 6/1994 | Hartmann | |
| 5,689,859 | A | 11/1997 | Cuche | |
| 5,711,056 | A | 1/1998 | Taguchi et al. | |
| 5,829,104 | A | 11/1998 | Gay et al. | |
| 5,870,803 | A | 2/1999 | Jort | |
| 6,094,782 | A | 8/2000 | Gay et al. | |
| 6,098,394 | A | 8/2000 | Hashimoto | |
| 6,101,842 | A | 8/2000 | Delacretaz | |
| 6,237,319 | B1 | 5/2001 | Amundsen | |
| 6,272,836 | B1 | 8/2001 | Fat | |
| 6,289,562 | B1 | 9/2001 | Linder | |
| 6,711,886 | B1 * | 3/2004 | Kwan | A44C 5/02 59/79.1 |
| 7,021,041 | B2 | 4/2006 | Verdon | |
| 7,191,586 | B2 | 3/2007 | Yamamoto | |
| 7,946,103 | B2 | 5/2011 | So | |
| 8,191,209 | B2 | 6/2012 | Wolfgang | |
| 8,567,172 | B2 | 10/2013 | Asami | |
| 8,576,036 | B2 | 11/2013 | Fullerton | |
| 8,739,369 | B2 | 6/2014 | Kaltenrieder | |
| 9,049,906 | B2 | 6/2015 | Schmidt | |
| 9,066,563 | B2 | 6/2015 | Chan | |
| 9,161,582 | B2 * | 10/2015 | Anderson | A41F 9/002 |
| 9,289,036 | B2 * | 3/2016 | Catheline | A44C 5/107 |
| 9,609,921 | B1 | 4/2017 | Feinstein | |
| 10,149,518 | B1 | 12/2018 | de Iuliis | |
| 10,492,574 | B2 * | 12/2019 | de Iuliis | G04B 37/1493 |
| 2002/0023320 | A1 | 2/2002 | Thalheim | |
| 2004/0163217 | A1 | 8/2004 | Ferrario | |
| 2006/0261958 | A1 | 11/2006 | Klein | |
| 2007/0279852 | A1 * | 12/2007 | Daniel | H04B 1/385 361/728 |
| 2008/0083101 | A1 | 4/2008 | Christian | |
| 2009/0031757 | A1 | 2/2009 | Harding | |
| 2012/0312052 | A1 | 12/2012 | Yliluoma | |
| 2013/0145795 | A1 | 6/2013 | Asami | |
| 2014/0101899 | A1 | 4/2014 | Moille | |
| 2015/0085623 | A1 | 3/2015 | Modaragamage | |
| 2015/0121668 | A1 | 5/2015 | Kaltenrieder | |
| 2016/0037841 | A1 | 2/2016 | Dey | |
| 2016/0037874 | A1 | 2/2016 | Webb | |
| 2016/0095731 | A1 | 4/2016 | Connor | |
| 2017/0215531 | A1 | 8/2017 | Wong | |
| 2018/0352914 | A1 | 12/2018 | Vuilleme | |

FOREIGN PATENT DOCUMENTS

| | | |
|---|---|---|
| CN | 1263440 | 8/2000 |
| CN | 1304292 | 7/2001 |
| CN | 2457893 | 11/2001 |
| CN | 1343474 | 4/2002 |
| CN | 1349388 | 5/2002 |
| CN | 1353984 A | 6/2002 |
| CN | 1429514 | 7/2003 |
| CN | 1965718 | 5/2007 |
| CN | 101558928 | 10/2009 |
| CN | 201393583 | 2/2010 |
| CN | 202233410 | 5/2012 |
| CN | 103156342 | 6/2013 |
| CN | 103844453 | 6/2014 |
| DE | 2619343 | 11/1977 |
| DE | 202012102780 | 9/2012 |
| EP | 0040504 | 11/1981 |
| EP | 1980170 | 10/2008 |
| EP | 2260910 | 12/2010 |
| EP | 2679113 | 1/2014 |
| JP | 2000-102404 | 4/2000 |
| JP | 2000-106920 | 4/2000 |
| KR | 200415109 Y1 | 4/2006 |
| TW | 201404328 | 2/2014 |
| WO | WO 94/18865 | 9/1994 |
| WO | WO 01/032045 | 5/2001 |
| WO | WO 03/056956 | 7/2003 |

OTHER PUBLICATIONS

Chinese Office Action from Chinese Patent Application No. 201810977358.8, dated Sep. 18, 2020, 18 pages including English language translation.

Chinese Office Action from Chinese Patent Application No. ZL2016211406009 dated Jun. 13, 2017, 12 pages.

International Preliminary Report on Patentability from PCT/US2015/044385, dated Nov. 27, 2015, 19 pages.

Revised Chinese Office Action from Chinese Patent Application No. ZL2016211406009, dated Sep. 21, 2017, 14 pages.

* cited by examiner

SEGMENTED ATTACHMENT DEVICE

CROSS-REFERENCE TO RELATED APPLICATIONS

This application is a continuation of U.S. patent application Ser. No. 15/968,608, filed May 1, 2018, which is a continuation U.S. patent application Ser. No. 14/820,084, filed Aug. 6, 2015, now U.S. Pat. No. 9,980,539, which is a nonprovisional patent application of, and claims the benefit to, U.S. Provisional Patent Application No. 62/036,087, filed Aug. 11, 2014 and titled "Segmented Attachment Device," and to U.S. Provisional Patent Application No. 62/129,956, filed Mar. 8, 2015 and titled "Segmented Attachment Device," the disclosures of which are hereby incorporated herein in their entirety.

FIELD

The embodiments disclosed herein relate to segmented attachment devices. In still greater particularity, the embodiments relate to segmented attachment bands for securing portable electronic devices to a user. By way of further characterization, but not by way of limitation thereto, the embodiments relate to a segmented band including removable links for securing a portable electronic device (or other device) on the wrist of a user. A manufacturing device for machining complex geometries associated with various portions of the attachment band is also disclosed.

BACKGROUND

Portable electronic devices such as watches, smart watches, smart phones and the like have become ubiquitous in recent years. Users carry these devices while moving in various environments during their daily activities. Modern portable electronic devices may be hand-carried by a user or they may be removably attached to the person of a user by means of straps or other tethers which may be decorative or aesthetically pleasing tethers. Many users have grown accustomed to carrying portable electronic devices while engaging in strenuous activities such as running, climbing and the like. Because users are in possession of these devices in such environments, they must be securely fastened to the person of the user or risk being lost or dropped. In a situation where the portable electronic device is dropped into water, the user may face a risk of losing the device altogether. Tethers prevent the user from dropping or losing the device and function as a convenience to the user.

Flexible bands or bracelets have been used to secure wristwatches to the person of a user for many years. These bands have made from a variety of materials including leather, cloth, metal, plastic and other suitable materials. From an aesthetic and durability point of view, metal wristbands have been very popular. However, metal wristbands have had some drawbacks including difficulty in sizing the wristband to a particular user which often requires special tools or expertise which may inconvenience a user. In addition, once sized, the band may need to be adjusted at a later time due to changes in the size of the wrist of the user or other factors. In such instances, resizing the wristband again often requires special tools or expertise and results in inconvenience to a user.

SUMMARY

The disclosed embodiments provide a user with a functional as well as aesthetically pleasing attachment means to secure an electronic device to his or her person or to otherwise securely transport a portable electronic device. In alternate embodiments, the attachment device may find use with electronic devices in other applications such as with medical equipment. The attachment band may be made of metal or other suitable material. The metal is formed into links which may be added or removed to allow a user easily and quickly to size the wristband to his or her person without requiring special tools or engaging the expertise of a jeweler or other specialist which may be costly and time consuming for the user.

In one embodiment, the watchband includes metal segments, some of which may be removable and some of which are fixedly attached to one another. The removable links may be added or removed and thus the length of the watchband may be varied according to the requirements and desires of the user. Some links of the watchband may be permanently attached so as to provide a base for attachment of the removable links. By varying the number of links in the watchband a user may size and resize the watchband as desired.

A clasp is also attachable to the segments so as to releasably lengthen the band and permit the user to take the watchband on and off his or her wrist as desired. The clasp includes nesting members to allow it to present an extremely low profile when the clasp is closed. The extremely low profile is both aesthetically pleasing and prevents the clasp from interfering with activities being performed by the user. That is, there is less likelihood of the clasp inadvertently catching on an unintended object if it presents the same thickness as the rest of the band as opposed to extending above the side profile of the watchband.

A manufacturing tool and method is also disclosed for efficiently and cost—effectively machining complex geometries to make the segments and clasp comprising the watchband aesthetically pleasing and functionally efficient.

Figure 1:
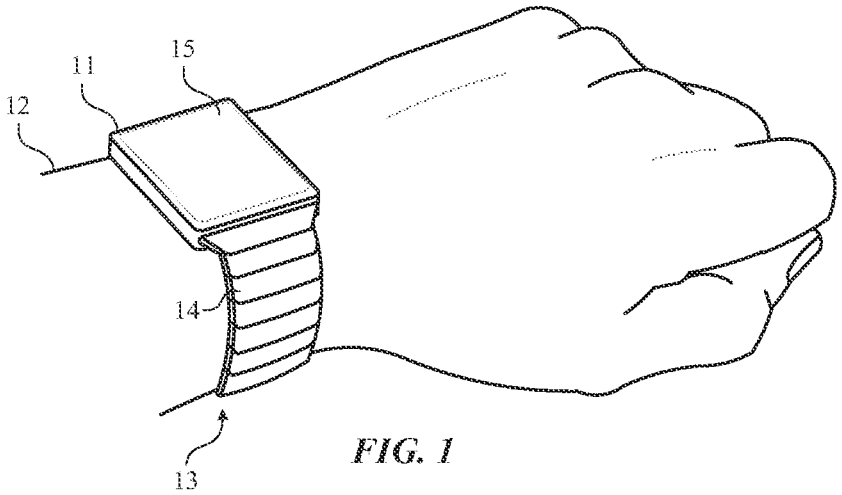
FIG. 1 shows an attachment band worn on the wrist of a user.

The use of the same or similar reference numerals in different drawings indicates similar, related, or identical items. The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference for particular materials, material properties, proportions, dimensions, commonalities of similarly-illustrated elements, or any other characteristic, attribute, or property for any element illustrated in the accompanying figures.

DETAILED DESCRIPTION

Reference will now be made in detail to representative embodiments illustrated in the accompanying drawings and in particular with reference to FIGS. 1-22. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims. For example, although many embodiments are described herein with reference to quick-release link segments for removably attaching a portable electronic device to the wrist of a user, other embodiments can take other forms or may be implemented with other dimensions, materials, configurations or in different form factors. For example, in some non-limiting embodiments, quick release link segments as described herein can be used separately from electronic devices as or as a portion of handles, closures, and/or attachment mechanisms associated with jewelry, luggage, clothing, footwear, athletic wear, handbags, accessories, branded or unbranded clothing, clothing accessories, merchandise fixtures, non-electronic watches and other wearables, and so on.

Additionally, those skilled in the art will readily appreciate that the detailed description given herein with respect to these Figures is for explanatory purposes only and should not be construed as limiting. Like reference numerals denote like structure throughout each of the various figures.

Referring to FIG. 1, an electronic device 11 (illustrated as, but not limited to, a watch) is shown as worn on the wrist 12 of a user. Electronic device 11 may be portable and may also be attached to other body parts of the user or to other devices, structures or objects. In one embodiment wristband 13 is flexible and includes a plurality of articulating metal segments or links 14 and is shown encircling the wrist 12 of a user. By securing electronic device 11 to the person of the user, wristband 13 provides security and convenience. In some embodiments, the electronic device 11 may include a display 15.

Although not shown, the wristband 13 may removably connect to the electronic device 11 or a portion thereof. In this fashion, the wristband may be removed from the electronic device 11 and replaced, thereby permitting a user to switch wristbands as necessary or desired.

Figure 2:
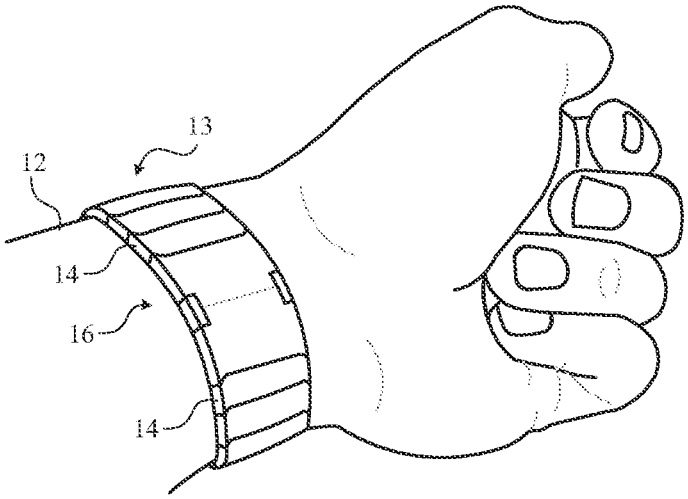
FIG. 2 shows the attachment band seen from the opposite side of the wrist of user.

Referring to FIG. 2, the wristband 13 of FIG. 1 is shown on the opposite side of the wrist 12 of user from electronic device 11. Wristband 13 includes link segments 14 and a clasp portion 16. In some embodiments, the link segments 14 can be formed from metal. Wristband 13 is sized to fit securely and comfortably onto wrist 12; the sizing of the wristband 13 may be altered by adding or removing links, as described in more detail herein. In order to accomplish this, the number of link segments 14 may need to be varied according to the size of wrist 12. That is, link segments 14 may to be added or removed to make the diameter of wristband 13 appropriate for a secure and comfortable fit (or any desired fit) on wrist 12.

Some links 14 of the watchband may be permanently attached so as to provide a base for attachment of the removable links. For example, wristband 13 may include a certain number of fixed links and a user may vary a number of removable links. The fixed links may attach to the electronic device 11 and/or to clasp portion 16. In conventional wristbands, resizing of wristband often requires special tools to add or remove links 14. For some wristbands, a specialist such as jeweler may be required to add or remove links 14 from wristband 13.

In modern society, users may not wish to be so inconvenienced. For example, many portable electronic devices (or mechanical devices, or other portable devices) may be ordered by users over the Internet. When the device is delivered to a user's home, he or she may be extremely reluctant to spend the time and resources necessary to take that portable electronic device and wristband to a jeweler or other expert to have the wristband sized. Alternatively, the use of special tools for a "do it yourself" sizing of wristband 13 may entail additional cost to the user or to the manufacturer and added inconvenience to, and effort by, a user. In an alternate embodiment, wristband 13 may cooperate with a second wristband that is similarly configured to permit a user to easily and conveniently mix and match wristbands.

Figure 3A:
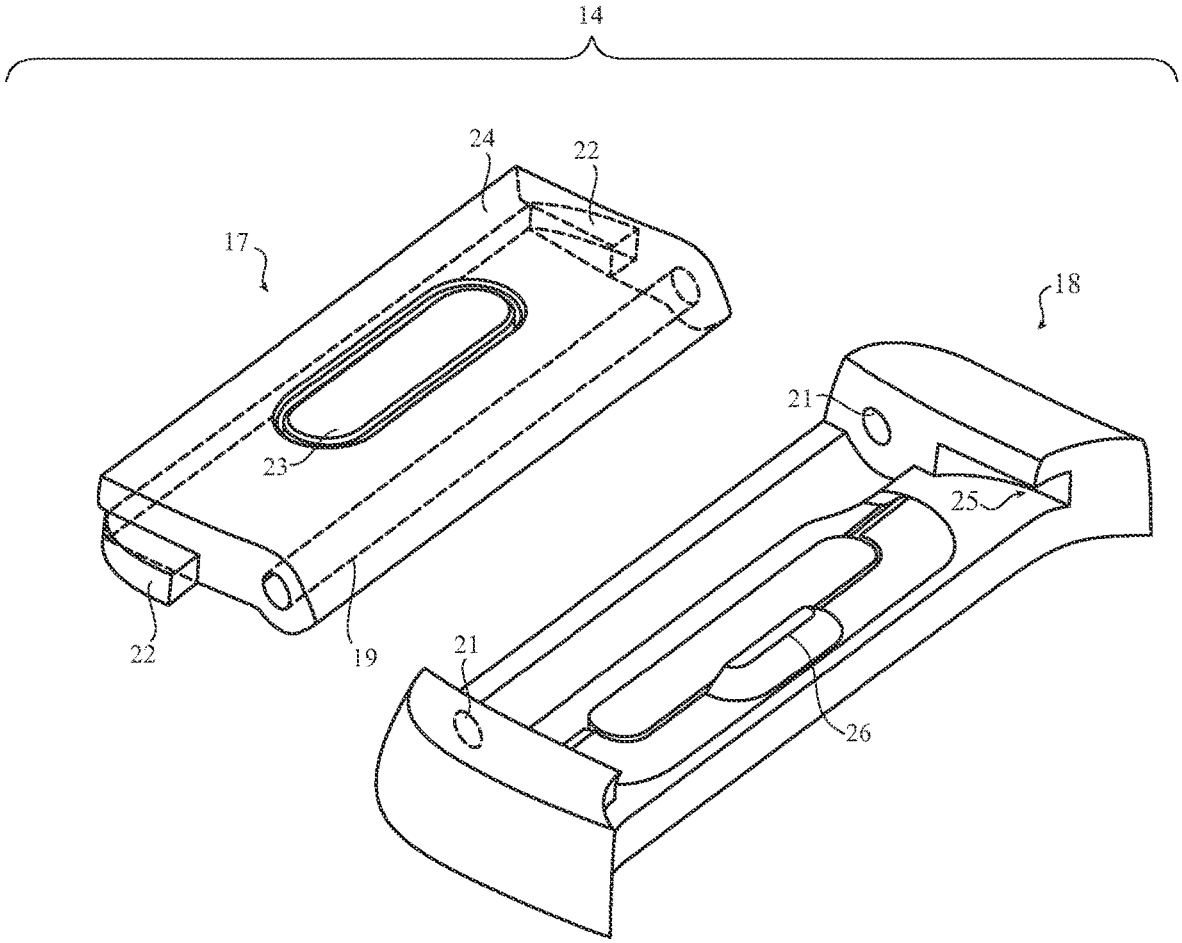
FIG. 3A shows a removable segment of the attachment band, separated into two pieces.

Referring to FIG. 3A, a so-called "quick-release" link 14 is shown with inner portion 17 and outer portion 18 separated. In normal operation, the quick-release link will have the inner portion 17 and outer portion 18 pivotally joined to form a single link. As will be discussed further below, inner portion 17 and outer portion 18 of one link segment 14 are connected by pin 19 which engages pivot holes 21 in outer portion 18; the pivot holes 21 may be blind holes that are not visible from an exterior of the link segment 14. Further, in some embodiments the pivot holes 21 may be drilled at an angle in order to maintain an unblemished outer surface of the quick-release link. The angle may be approximately eight degrees, in some embodiments, although this angle may vary in other embodiments.

The pin 19 may be a stepped pin so that its end engages a sidewall of the pivot hole 21, rather than engaging the bottom of the pivot hole, thereby securing the inner and outer portions.

Inner portion 17 may articulate with respect to outer portion 18, thus providing flexibility to wristband 13 when worn by a user. Inner portion 17 includes wing portions 22 on each side of inner portion 17 and a button 23 on surface 24 of inner portion 17. Outer portion 18 includes curvilinear receiving portions 25 for engaging with wing portions 22 on an adjacent link segment. Outer portion 18 also includes spring-loaded engagement mechanism 26 for releasably engaging with an inner portion 17 of an adjacent link segment 14. As depicted, spring-loaded engagement mechanism 26, when viewed from above, can take a substantially sphero-cylindrical shape (e.g., capsule shape). In other embodiments, spring-loaded engagement mechanism 26 can take other forms such as a rectangular, circular, semicircular, or trapezoidal shape. In still further embodiments, spring loaded engagement mechanism 26 can take any other suitable shape.

As depicted, spring-loaded engagement mechanism 26, when viewed from a side, can be stepped. As illustrated, the step portion may be formed at the longitudinal endpoints of spring loaded engagement mechanism 26, but this is not required of all embodiments. Further, although illustrated with a single sloped step in FIG. 3A, certain implementations of spring-loaded engagement mechanism 26 can have a greater or fewer number of steps. In still further embodiments, a step may not be required or favored and spring-loaded engagement mechanism 26 may be substantially flat, for example as illustrated in FIGS. 4-5, 10, and 23.

Link segments 14 may include continuous unblemished surfaces that can be polished to provide an aesthetically pleasing appearance to wristband 13. While shown as rectangular or square, link segments 14 could also be round or other complex geometries.

Figure 4:
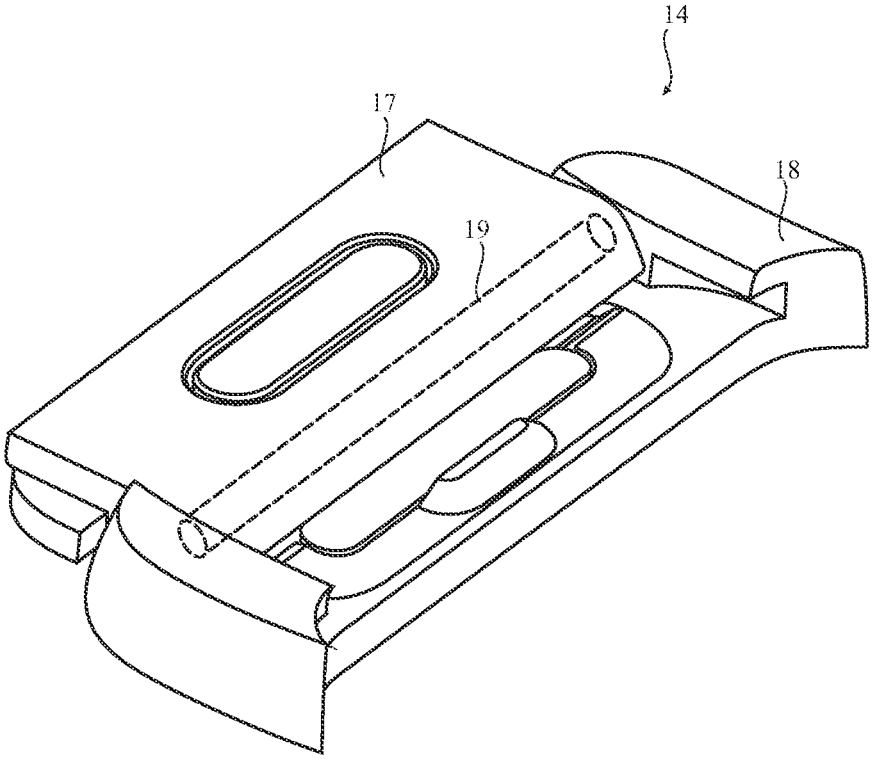
FIG. 4 shows the removable segment of FIG. 3A with inner and outer portions joined.
Figure 5A:
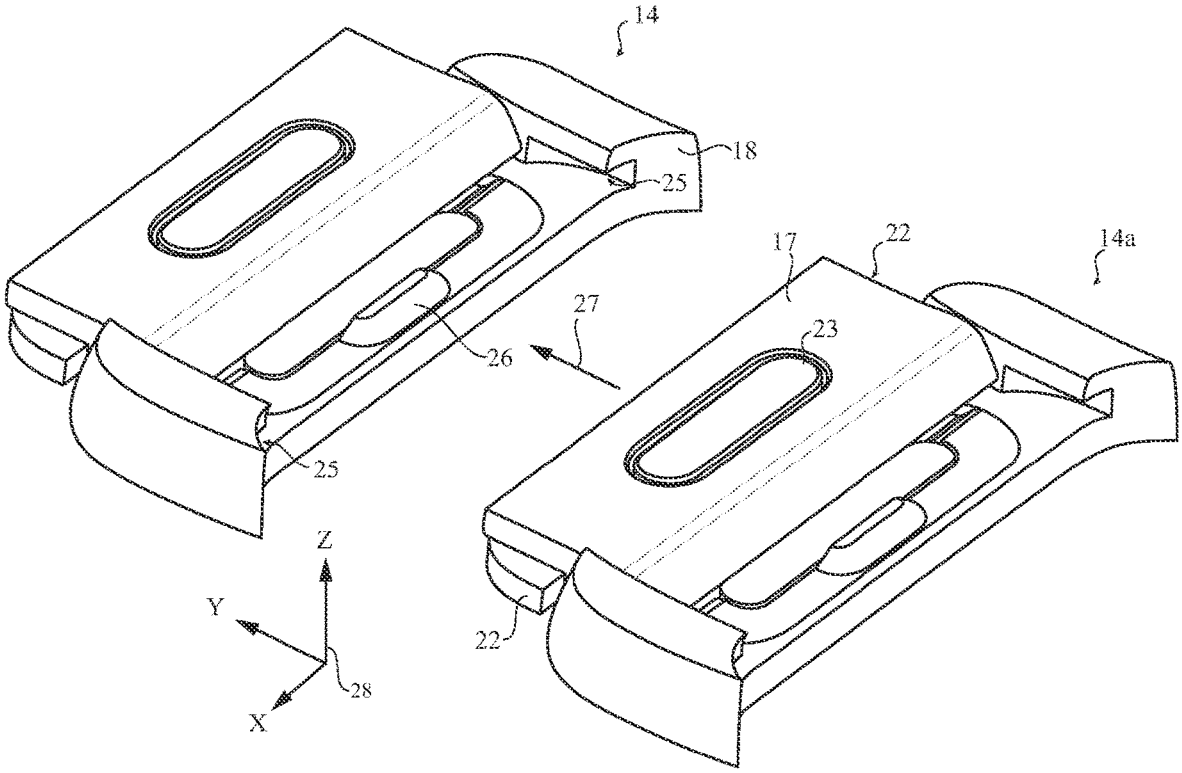
FIGS. 5A-5B each show two removable segments of an attachment band being joined.

Referring to FIG. 4, link segment 14 of FIG. 3A is shown with inner portion 17 and outer portion 18 joined by pin 19. Referring to FIG. 5A, link segments 14 and 14*a* may be engaged with one another in the direction of arrow 27. That is, inner portion 17 of link segment 14*a* may be releasably engaged with outer portion 18 of link segment 14 by the engagement of wing portions 22 on link segment 14*a* with receiving portions 25 on outer portion 18 of link segment 14, along with the engagement of spring loaded engagement mechanism 26 to inner portion 17 of segment 14*a* that releasably latches inner portion 17 of link segment 14*a* to outer portion 18 of link segment 14. To securely engage inner portion 17 of link segment 14*a* with outer portion 18 of link segment 14, inner portion 17 may be secured in three degrees of freedom. That is, inner portion may be contained from moving along three axes (x, y, z) 28. The x and y axes are in the plane of FIG. 5A while the z axis is perpendicular to the plane of FIG. 5A. The engagement of wing portions 22 with receiving slots 25 serve to constrain inner portion along the x and z axis. However, movement along the y axis (into and out of engagement with outer portion 18) is constrained by the interaction of engagement mechanism 26 and inner portion 17 as described below.

Figure 3B:
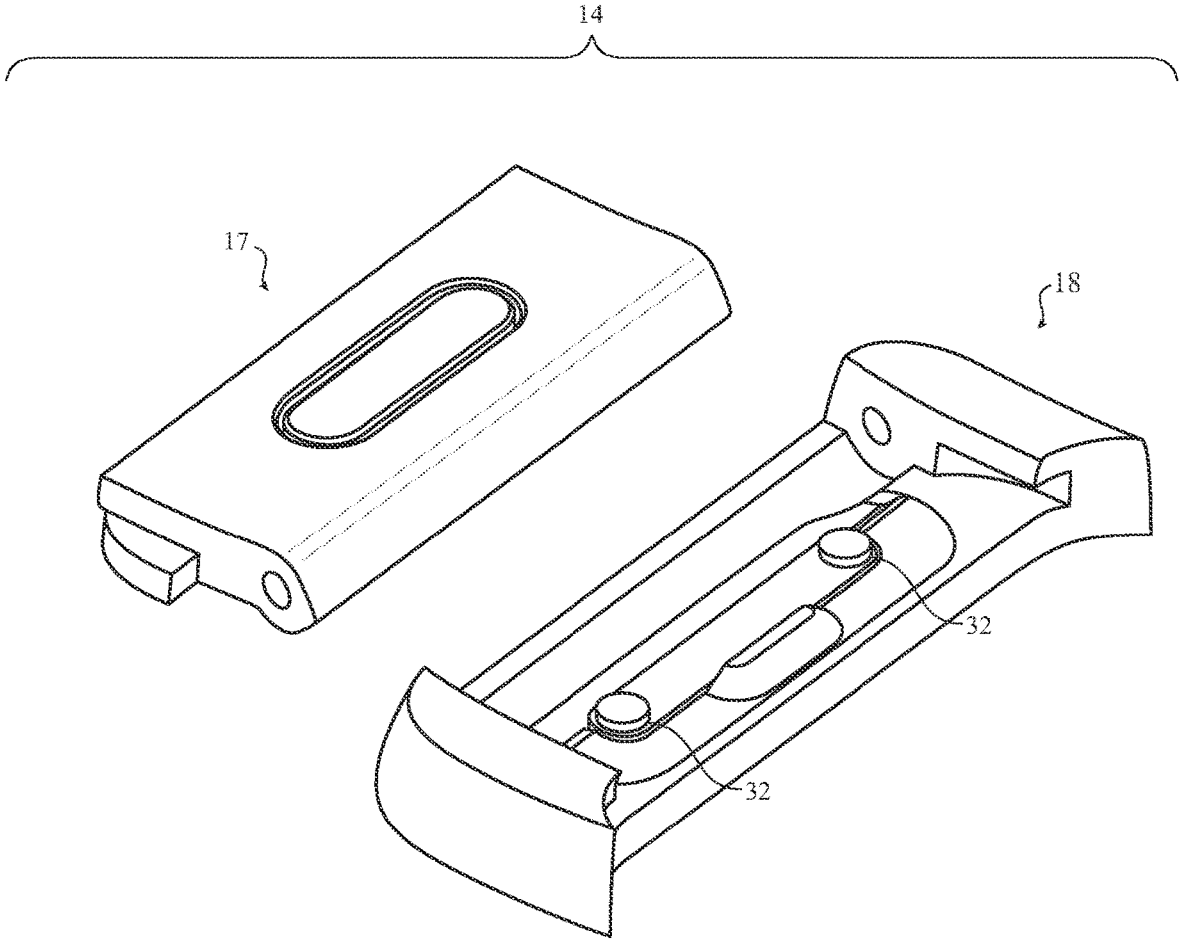
FIG. 3B shows another example of a removable segment of an attachment band, separated into two pieces.
Figure 6A:
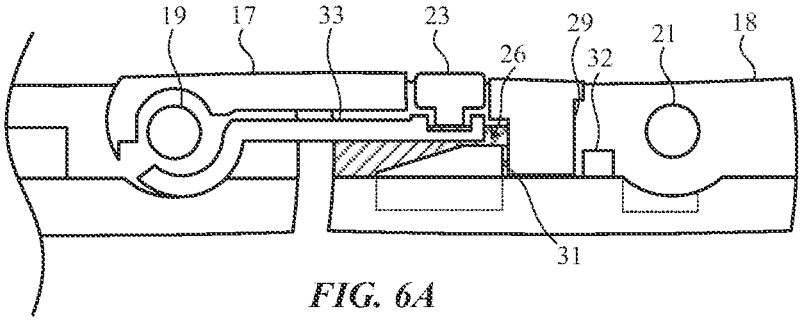
FIGS. 6A-6B show side views of an engagement mechanism of a removable segment.
Figure 6B:
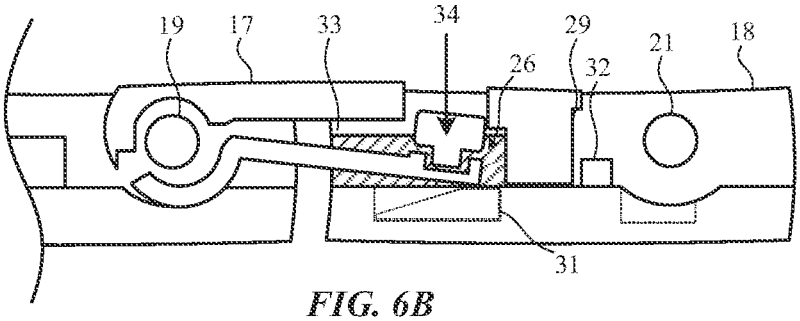

The releasable engagement of inner portion 17 with engagement mechanism is shown in FIGS. 6A-6B. That is, when inner portion 17 moves along the y-axis in the direction of arrow 27, engagement mechanism 26 (which includes protrusion 31) latches outer portion 18 to inner portion 17. Protrusion 31 is received in a recess in the underside of inner portion 17 as shown in FIG. 6A in phantom. In certain embodiments, the end of protrusion 31 may be flat or blunt, as illustrated in FIGS. 6A-6B. In other embodiments the edge or protrusion 31 may be sloped, as illustrated in FIGS. 3A & 3B. Still other embodiments may combine the two such that the edge is partly sloped and partly blunt. A fully or partly blunt edge may resist disconnection of adjacent links when the links are pulled away from one another.

Engagement mechanism 26 can optionally include additional supports 32, such as shown in FIG. 3B, which restrain inner portion from additional motion along the y-axis. That is, wall 29 of inner portion 17 is contained between protrusion 31 and supports 32 (see, e.g., FIG. 5B) which prevent motion along the y axis. Inner portion 17 is thus locked into engagement with outer portion 18 of the adjacent link segment 14. As will be discussed below, engagement portion 26 is resiliently contained in outer portion 18 such that a user, by depressing button 23 in inner portion 17, may cause armature 33 to move downward in FIG. 6B (as shown by arrow 34) which causes armature 33 to contact protrusion 31, which in turn causes engagement mechanism 26 to depress downwardly and disengage protrusion 31 from inner portion 17. In this manner, inner portion 17 may be separated from outer portion 18 of an adjacent segment 14. As can be appreciated, segments 14 may be added to or subtracted from wristband 13 in this manner.

In some embodiments, a tool may be used to separate links instead of pressing the button. For example, button 23 may be replaced by an access opening into which a tool (such as the end of a paperclip or a small screwdriver) may be inserted to depress armature 33 to engage protrusion 31 and disengage engagement portion 26 from inner portion 17. Alternatively, links may be separated by depressing protrusion 31 directly.

Figure 7A:
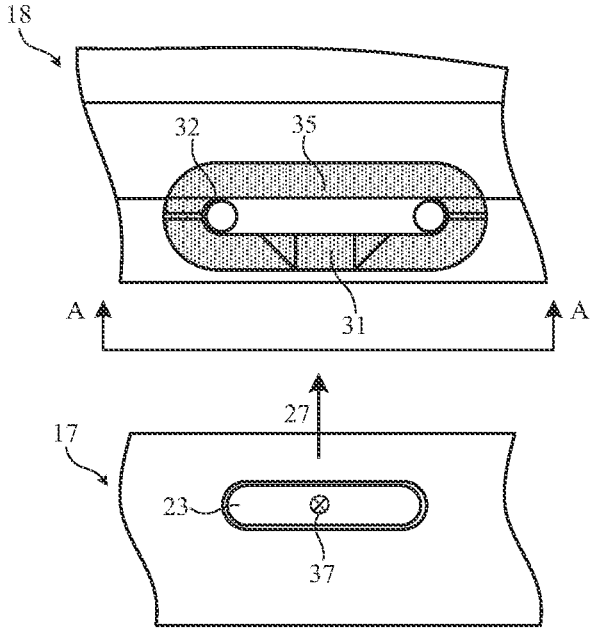
FIG. 7A shows a top view of the engagement mechanism of FIG. 6A.
Figure 7B:
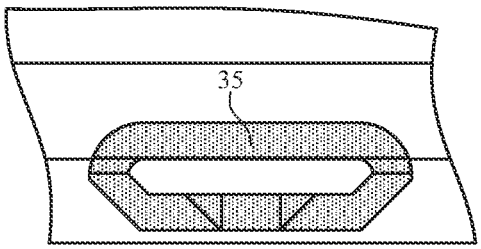
FIG. 7B shows a top view of an alternate spring-like mechanism that may be used with the engagement mechanism of FIG. 6A.

Referring to FIG. 7, a top view of engagement mechanism 26 is shown. A spring-like mechanism 35, which may, in one embodiment, be an approximately 0.25 mm thick stainless steel plate, is spot welded or otherwise connected to one or more supports. Mechanism 35 is flexible such that it may be depressed downwardly in the direction of arrow 37 but will return to its normal non-deflected position in the absence of such force. As described above, the force is provided by a user who depresses button 23 in inner portion 17 (see FIG. 6A). Thus, protrusion 31 may be moved out of engagement with inner portion 17 by depressing button 23 on inner portion 17 and, upon separation of inner portion 17 from outer portion 18, mechanism 35 resiliently returns to its non-deflected position. In other embodiments, spring-like mechanism 35 can take other shapes, such as that depicted in FIG. 7B.

Figure 5B:
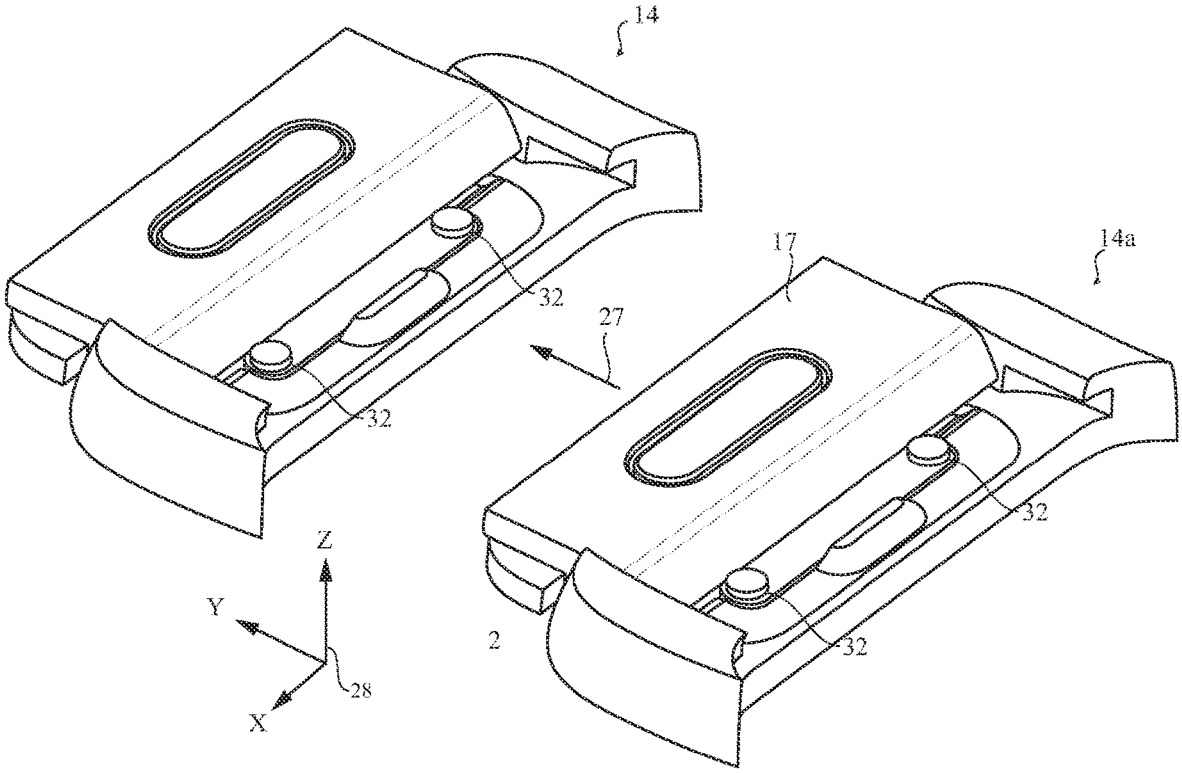

When it is desired to engage inner and outer portions, as discussed in FIG. 5A, sliding inner portion 17 into outer portion 18 of an adjacent segment 14 results in inner portion 17 contacting protrusion 31 on engagement mechanism 26; the upward bias of spring-like mechanism 35 may be overcome by the force exerted by a user engaging inner portion 17 with outer portion 18. This results in protrusion 31 being forced downward, allowing inner portion 17 to slide against supports 32 which will prohibit further advance of inner portion 17 with respect to outer portion 18. Protrusion 31 may engage a recessed portion of the underside of inner portion 17; inner portion may be constrained from movement along the y axis by wall 29, a segment of which is received between protrusion 31 and supports 32 (e.g., such as shown in FIG. 5B).

Figure 8A:
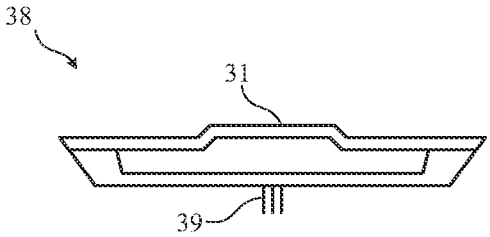
FIGS. 8A-8B show an example engagement mechanism.
Figure 8B:
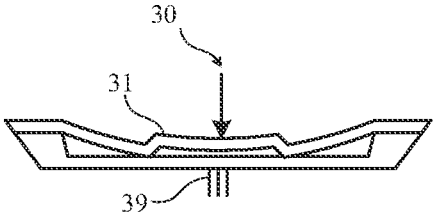

Referring to FIGS. 8A-8B, various embodiments of engagement mechanism 26 are shown in which a spring-like latch 38 may be used in place of metal plate 35. FIGS. 8A-8B are illustrated as front views taken along line A-A on FIG. 7A of engagement mechanism 26, presented for clarity without the example structure depicted in FIG. 7A. In these embodiments, spring-like latch 38 can be welded to outer portion 18 at attachment point 39 such that, when inner portion 17 is slid onto outer portion 18, the force exerted by a user depresses latch 38 in a downward direction (as shown by arrow 30) through the contact of wall 29 on inner portion 17 against protrusion 31.

In one embodiment, such as shown in FIG. 8B, the latch 38 can be pressed downwardly such that the spring-like latch 38 bends over a fulcrum (not shown) separate from the attachment point. For example, the fulcrum may be a portion of the outer portion 18. In another embodiment, the fulcrum may be a portion of the inner portion 17. In still further embodiments, the fulcrum can be a separate component that is adhered to or disposed below to the spring-like latch 38. In some embodiments, more than one fulcrum can be used. In these examples, the spring-like latch 38 can bend and/or deform, in more than one location.

In another embodiment, the latch can bend downward in a cantilever fashion to release adjacent links.

Generally, the upward spring bias of latch 38 allows protrusion 31 to move upwardly (opposite the direction of arrow 30) to engage with the backside of wall 29 once wall 29 has passed over protrusion 31 in order to secure inner portion 17 to outer portion 18.

Figure 9:
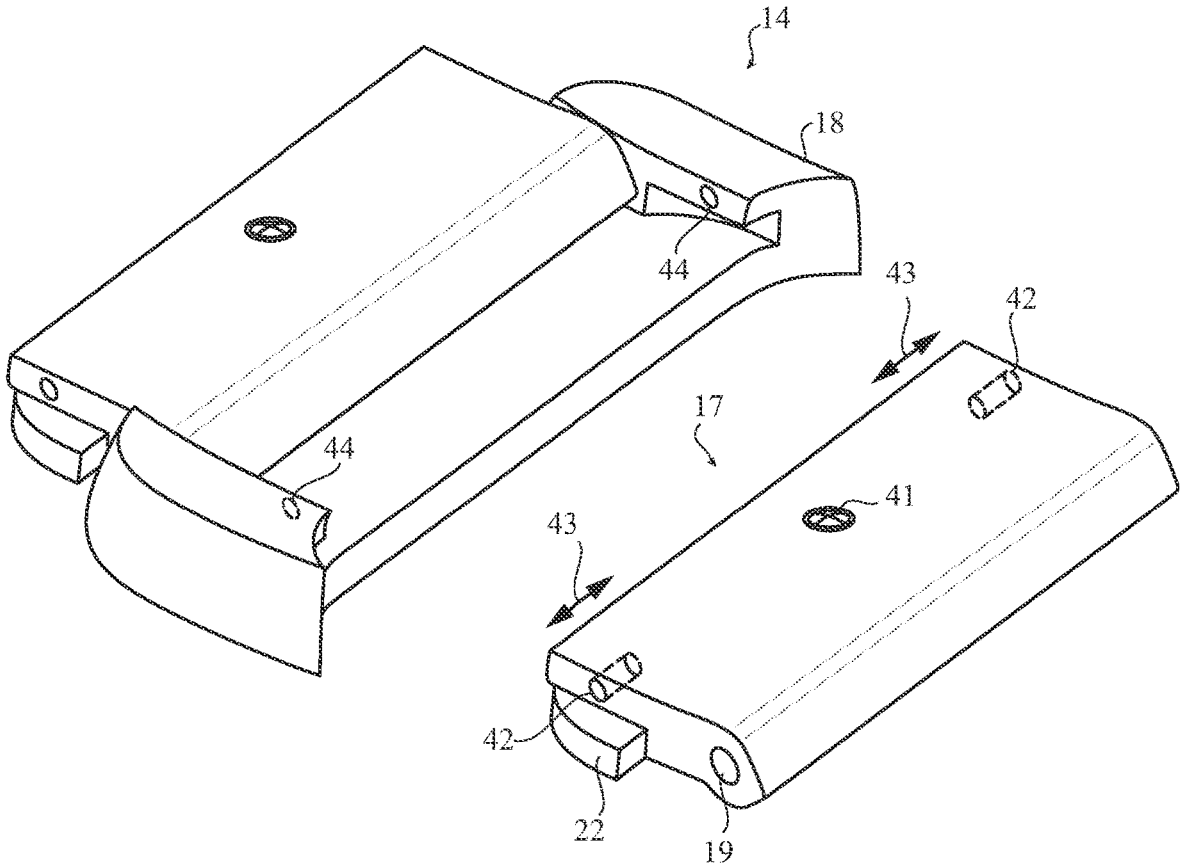
FIG. 9 shows yet another alternate engagement mechanism for a removable segment.

Referring to FIG. 9, an alternate embodiment of a latching mechanism is shown. A screw 41 is connected to a pair of retractable pins 42 on each side of inner portion 17. Screw 41 may be rotated to move retractable pins 42 into and out of inner portion 17 in the directions indicated by arrows 43. Pins 42 engage into and out of holes 44 in an adjacent outer portion 18 to releasably engage outer portion 18 and inner portion 17 of adjacent link segments 14. In this embodiment a tool, such as a screwdriver or other suitable tool (not shown), may be used to rotate screw 41, thereby causing retractable pins to engage or disengage with holes 44.

Figure 10:
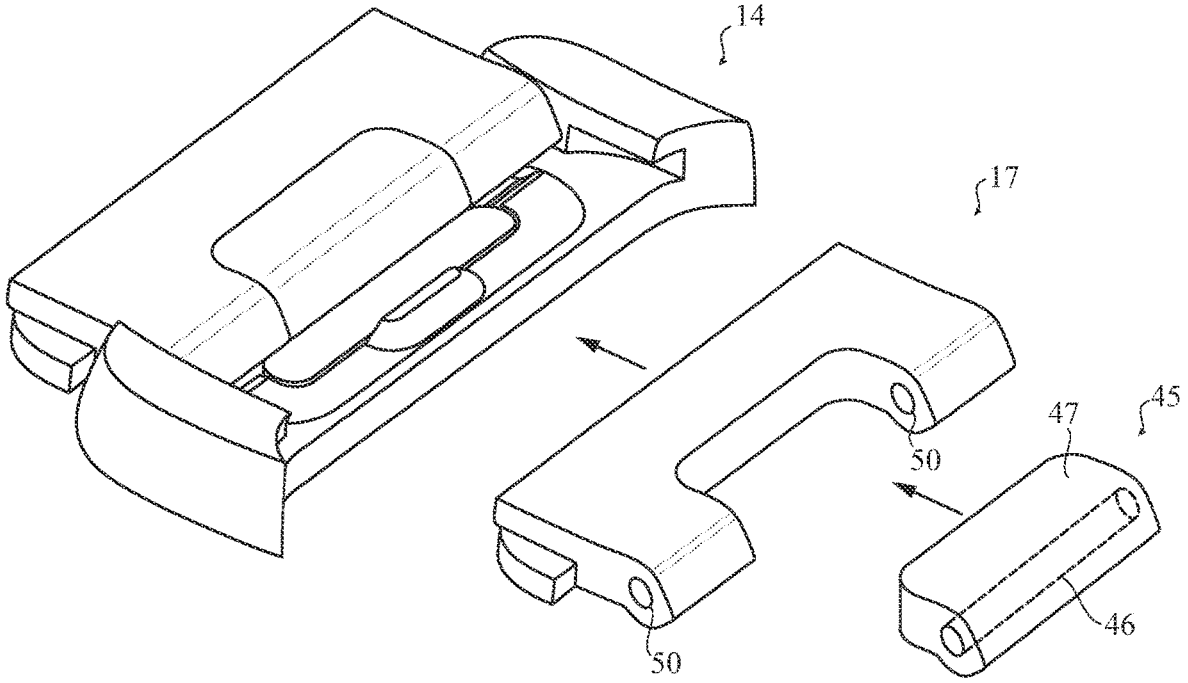
FIG. 10 shows an alternate embodiment of an inner portion of a removable segment.

Referring to FIG. 10, another alternate embodiment is shown. Here, outer portion 18 is as described above with respect to FIG. 3A. Inner portion 17 may be inserted into outer portion 18 of an adjacent segment 14, as described above, such that engagement mechanism 26 engages inner portion 17 as described herein. However, inner portion 17 includes an activating portion 45 which is rotatably connected to inner portion 17 by pin 46 in holes 50. Accordingly, activating portion 45 may be depressed by applying pressure to front portion 47, thus causing front portion 47 to rotate on pin 46 such to contact and depress engagement mechanism 26 thereby disengaging inner portion 17 from outer portion 18 of an adjacent segment 14.

Referring to FIGS. 11A-11C and 12A-12C, a side view of a clasp 100 suitable for use with an attachment mechanism and one or more links as described herein is shown. The clasp may correspond, for example, to clasp 16 of FIG. 2. As shown in the figures, a first and second clasp body segment 104, 106 may form a substantially unbroken, curved surface in conjunction with buttons 102 when the clasp is closed (see, e.g., FIGS. 11A and 11B); this substantially unbroken, curved surface is approximately the same thickness as a link segment 14. The base 108 of the clasp may be a smooth surface. The body segments 104, 106 may be considered, or equivalent to, elongated link segments that define recessed on their lower surfaces to accommodate the arms and the bridge segment 119 connecting the arms ("cored" link segments). In some embodiments, multiple cored link segments of approximately the same dimensions as standard link segments 14 may be used in place of one elongated cored link segment.

In addition, the ends of the body segments 104, 106 connected to the arms 110 may be notched or stepped down to accommodate the buttons 102 when the clasp is closed. Thus, when the clasp is closed, the buttons 102 nest within the notches formed at the arm ends of the body segments 104, 106; likewise, when the clasp is closed the body segments 104, 106 abut one another.

Figure 12A:
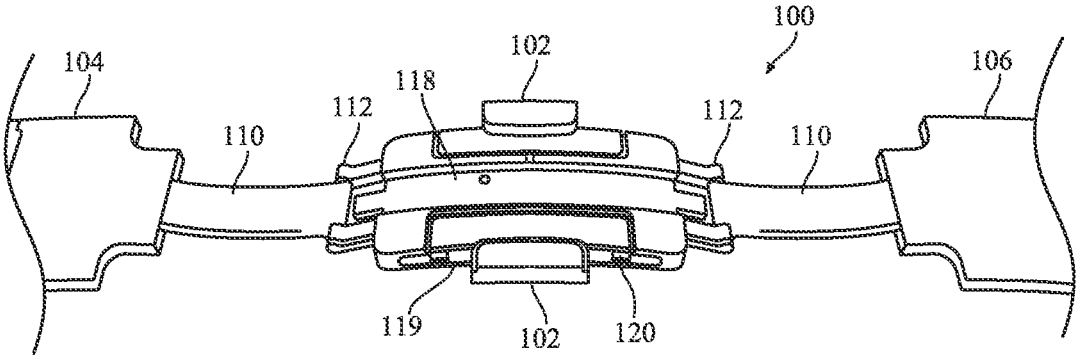
FIGS. 12A-12I show additional views of various embodiments of a clasp that may be used with an of attachment band.
Figure 11B:
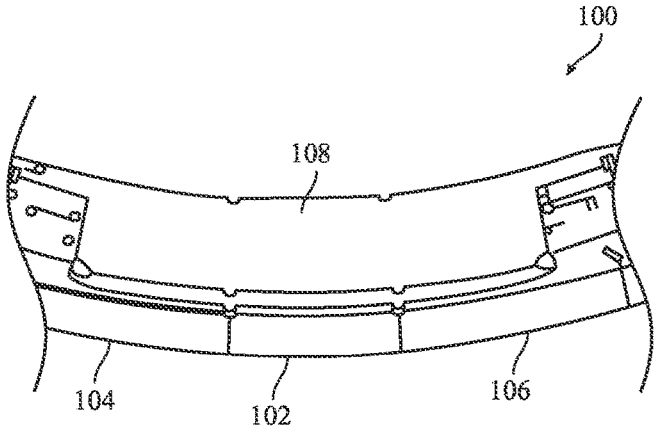
Figure 12B:
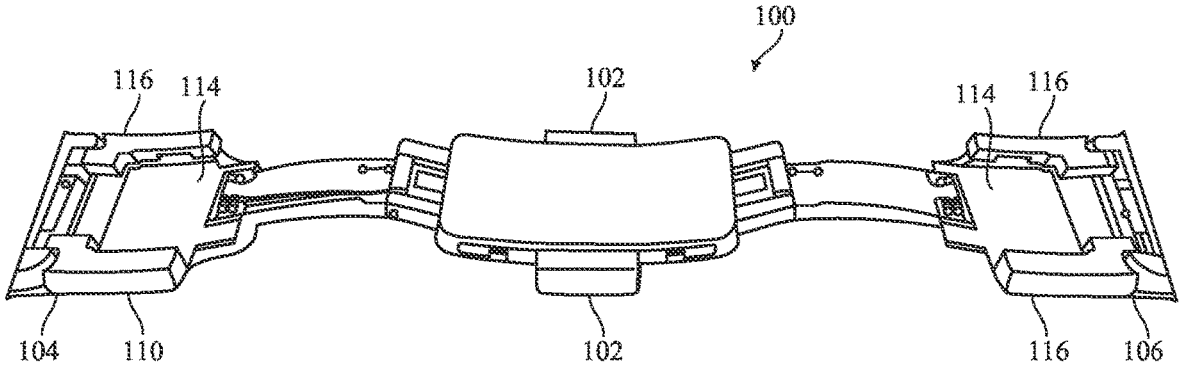
Figure 11C:
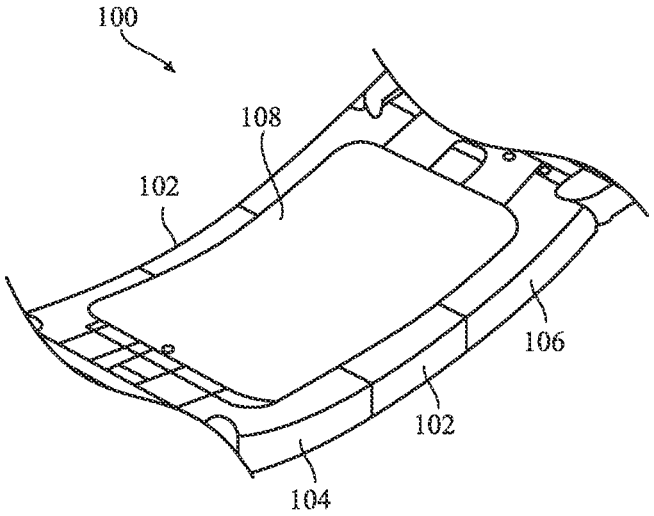
Figure 12C:
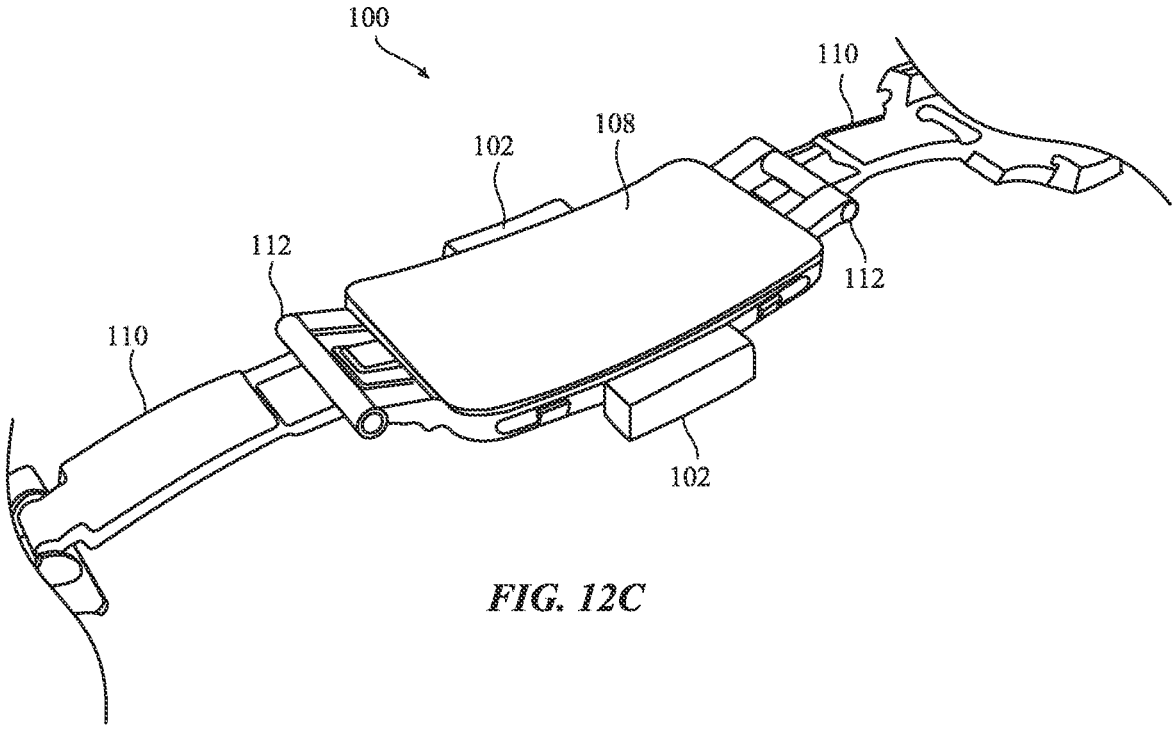

The clasp may be opened by pressing buttons 102 located on opposing sides of the bridge segment 119, as described in more detail below. FIGS. 12A-12C depict the clasp in an open configuration. Arms 110 connect pivots 112 to body segments 104, 106. It should be noted that the body segments 104, 106 may also pivot with respect to the arms 110 at the connection of the arm and body segment.

When the clasp is closed, the ends of arms 110 abut one another and are received in groove 118 between the buttons 102. This permits the body segments 104, 106 to abut one another and lie substantially flush with the buttons 102 on all three adjacent sides (e.g., top, bottom, and sidewall).

Figure 11A:
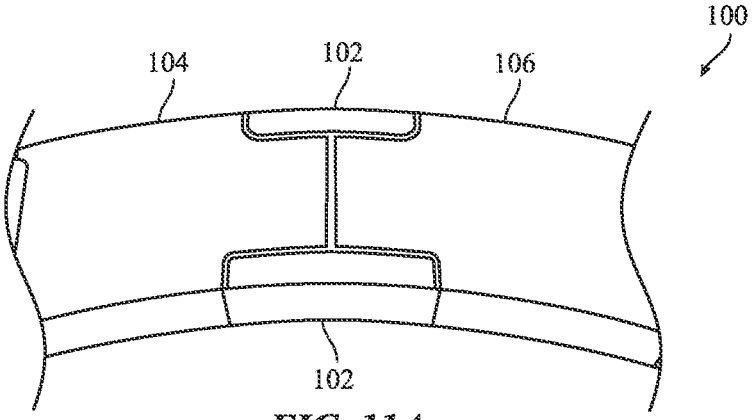
FIGS. 11A-11C show views of various embodiments of a clasp that may be used with an attachment band.

Turning momentarily to FIG. 12B, sidewalls 116 of the body segments 104, 106 define cavities 114. These cavities typically overlie the central clasp structure defining the groove 118 and from which the buttons protrude. Generally, when the clasp is closed, the outer sidewalls of the buttons are flush with the outer sidewalls of the body segments as shown in FIG. 11A. The cooperation of the cavities 114 and the cavity portions within the adjacent body segments can conceal the clasp structure when the clasp is closed.

A tooth 120 may protrude from each button 102 or may be articulated by operation of the buttons 102. That is, pressing the buttons 102 inward may cause the teeth to move inward while releasing the buttons may return the teeth 120 to the rest position shown in FIG. 12A. The teeth 120 may be received in undercuts of the cavities 114 (such as detents) and next beneath the sidewalls 116 of the body portions 104, 106 when the buttons are in a default state (e.g., no force is applied to the buttons 102). Accordingly, the teeth 120 secure the body segments 104, 106 to the base 108 of the clasp until the buttons 102 are pressed. Pressing the button (s) 102 moves the teeth inward toward a center of the base 108 (e.g., into apertures 114), thereby permitting the body segments 104, 106 to separate from the base. The teeth may be formed at a backdraft angle in order to permit the clasp to pop open when force is applied to the top of the clasp while in a closed position. Such force may cause the teeth to slip out from beneath the sidewalls 116, thereby opening the clasp without requiring the buttons be pressed. This may prevent injury to a wearer in certain situations, as well as potentially preventing damage to the clasp assembly.

Some embodiments may omit the teeth 120 and replace them with other closure elements. For example, bumps or other protrusions may take the place of teeth. These interference elements may bend or otherwise deform when the clasp is closed and/or opened, thereby resisting the opening or closing of the clasp until sufficient force is exerted. This may secure the clasp in a closed position, but still permit it to be opened by a user while resisting accidental or casual opening forces.

Figure 12D:
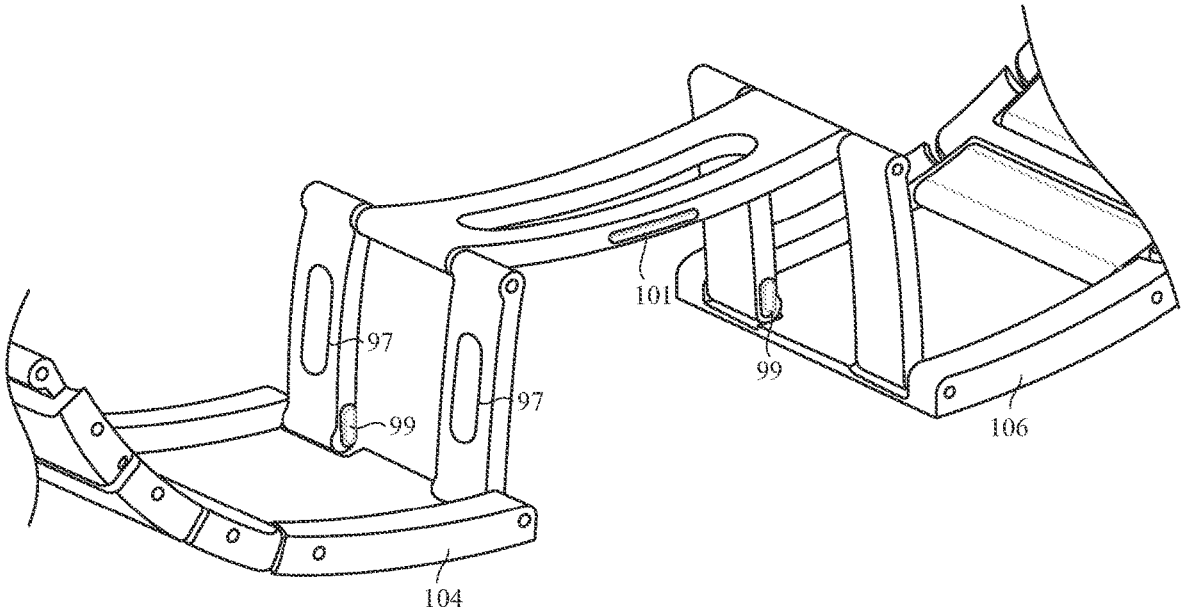

Yet another embodiment may eliminate the teeth 120 and employ one or more sets of magnets to hold the clasp in a closed position, such as shown in FIG. 12D. In such an embodiment, magnets 97 may be located on each arm and may attract the arm to a cored link (e.g., body segment 104, 106). A user may pull the clasp open by overcoming the magnetic force. In yet other embodiments, a second set of magnets may be affixed in or to the body segments to strengthen the magnetic attraction. In still further embodiments, such as depicted in FIG. 12D, detents 99 can be configured to interface with recesses 101. In many cases, body segments 104, 106 each can include one detent 99 that is configured to interface with a single detent 101. In other embodiments, body segments 104, 106 can each include one detent 99 that is configured to interface with an independent detent 101.

Figure 12E:
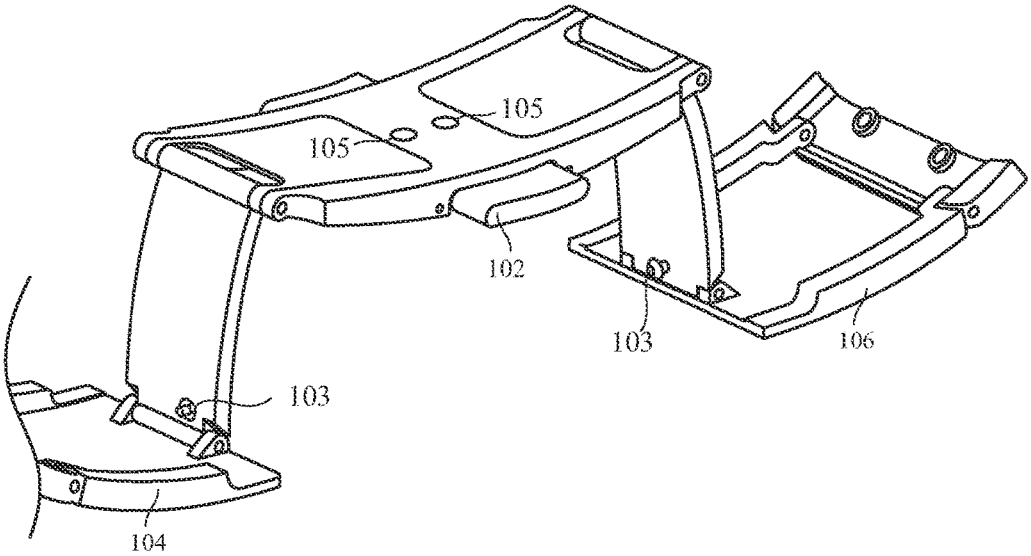
Figure 12F:
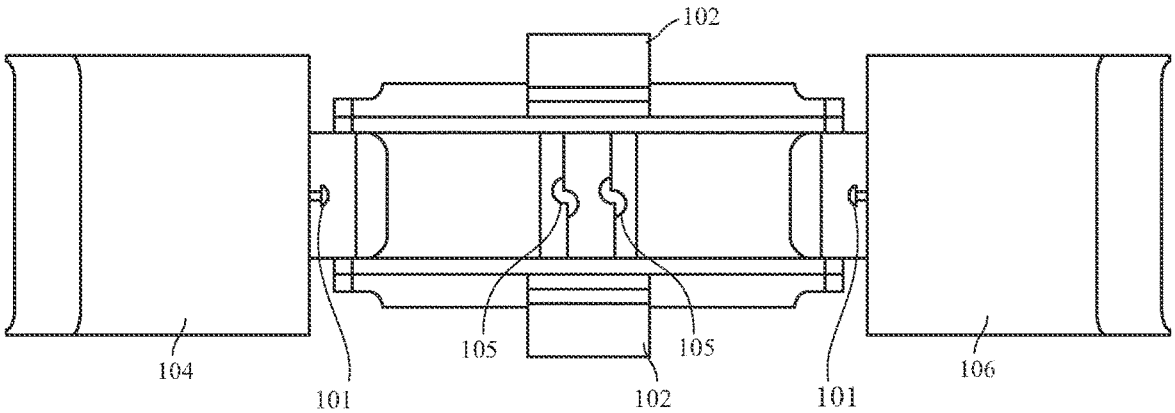

Yet another embodiment may include barbs 103 on arms of the body segments 104, 106 which can be configured to be retained by sliding traps 105, such as depicted in FIGS. 12E-12F. In these embodiments, upon closure, barbs 103 can be pushed into and through the sliding traps 105 such that clasp 100 can be retained in the closed position. To release the body segments 104, 106, sliding traps 105 upon compression of one or more buttons 102. In these embodiments, depression of buttons 102 can cause sliding traps 105 to release barbs 103, which, in turn, can release clasp 100.

Figure 12G:
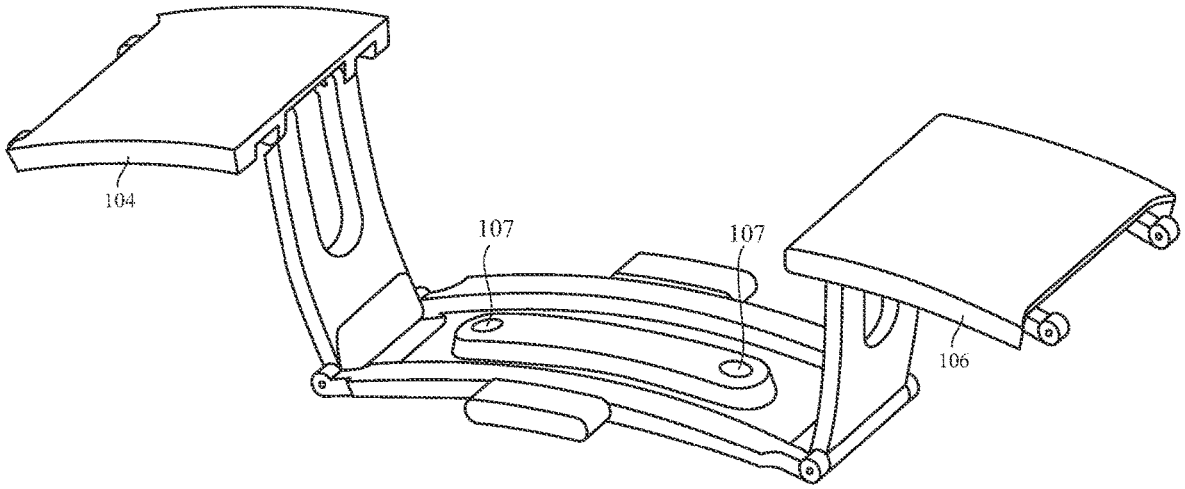
Figure 12H:
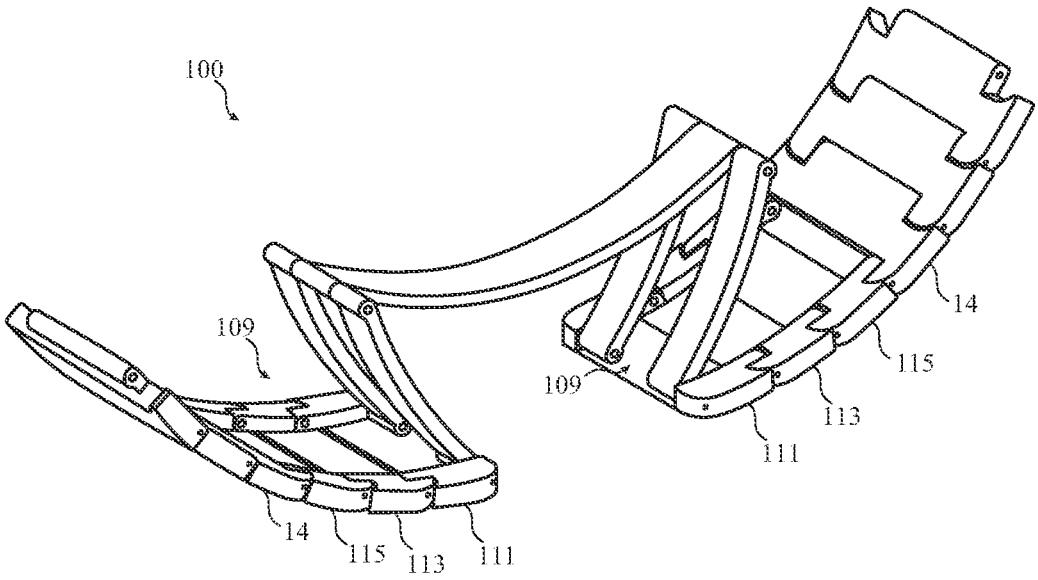

Yet another embodiment can trap barbs 103 in another manner. For example, barbs 103 can be retained within a magnetized recess 107, such as depicted in FIG. 12G. In other embodiments, magnetized recess 107 can also include one or more sliding traps released by buttons in accordance with other embodiments described above.

It should be appreciated that the pivots of the clasp 100 may nest when the clasp is in a closed position. Likewise, the overall height of the clasp may be substantially the same as the overall height of any link segment 14, thereby creating a substantially continuous and/or smooth or seamless geometry for the overall attachment mechanism. Further, given the lack of any holes in either a link segment 14 or the clasp 100 that are visible from an exterior of the attachment mechanism (e.g., band), the sidewalls may present a smooth, finished look as well with a similarly substantially continuous profile.

Figure 12I:
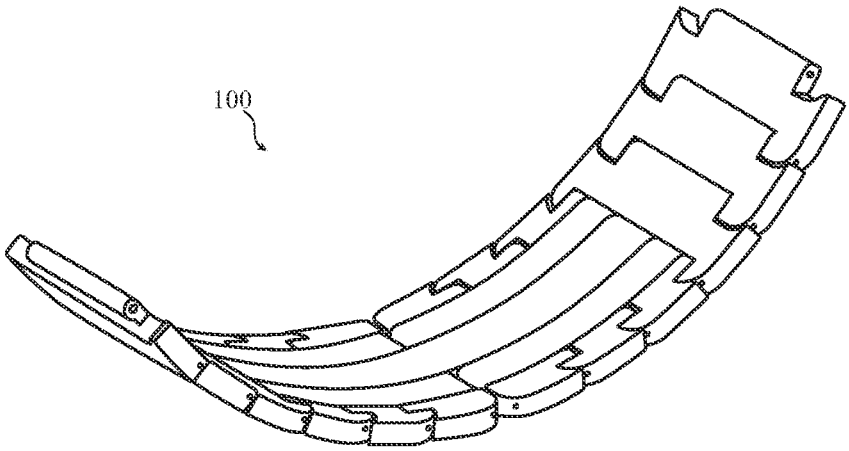

In still further embodiments, clasp 100 can be received, when closed, into clasp recess 109. In many examples, clasp recess 109 can be defined by a single segment 14 of clasp 100 (not shown). In other examples, clasp recess 109 can be defined by the combination of multiple clasp segments, such as a first segment 111, a second segment 113, and a third segment 115. In still further examples, more than three or less than three segments can cooperate to define clasp recess 109. In these examples, the clasp segments cooperating to define clasp recess 109 can connect to one or more segments 14 of the wristband 13. As noted above, it should be appreciated that the pivots of the clasp 100 may nest when the clasp recess 109 is in a closed position, such as shown in FIG. 12I.

Figure 13:
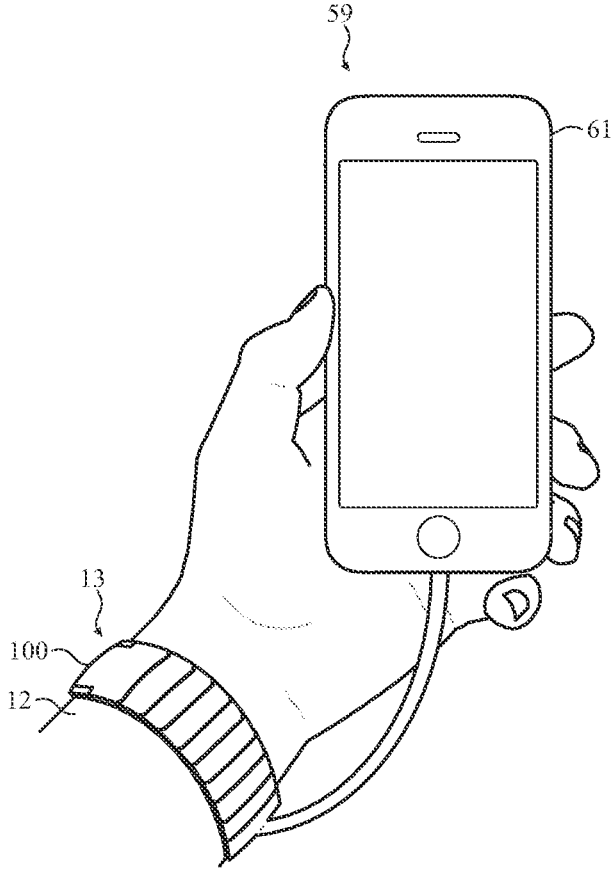
FIG. 13 shows a sample electronic device tethered to a user by a sample segmented wristband.

FIG. 13 illustrates another embodiment including an electronic device 59 (which may be a mobile phone) as held by a user. Electronic device could also be a laptop computer, tablet computing device, media player, personal digital assistant, health monitoring device, wearable computing device or other electronic device. In one embodiment, device 59 may be tethered to wrist 12 of a user directly by wrist band 13, or band 13 may be attached to another part of the user or his clothing. Attachment band may include a wristband 13 having segments 14 and clasp 100, as generally described herein. Band 13 may releasably engage with housing 61 of portable electronic device 59 through operation of an attachment structure, which may be an interoperable and/or interchangeable attachment structure that permits swapping of bands and/or devices. Such an attachment structure may be affixed to or formed with one or more segments 14, whether releasable or permanent.

Figure 14:
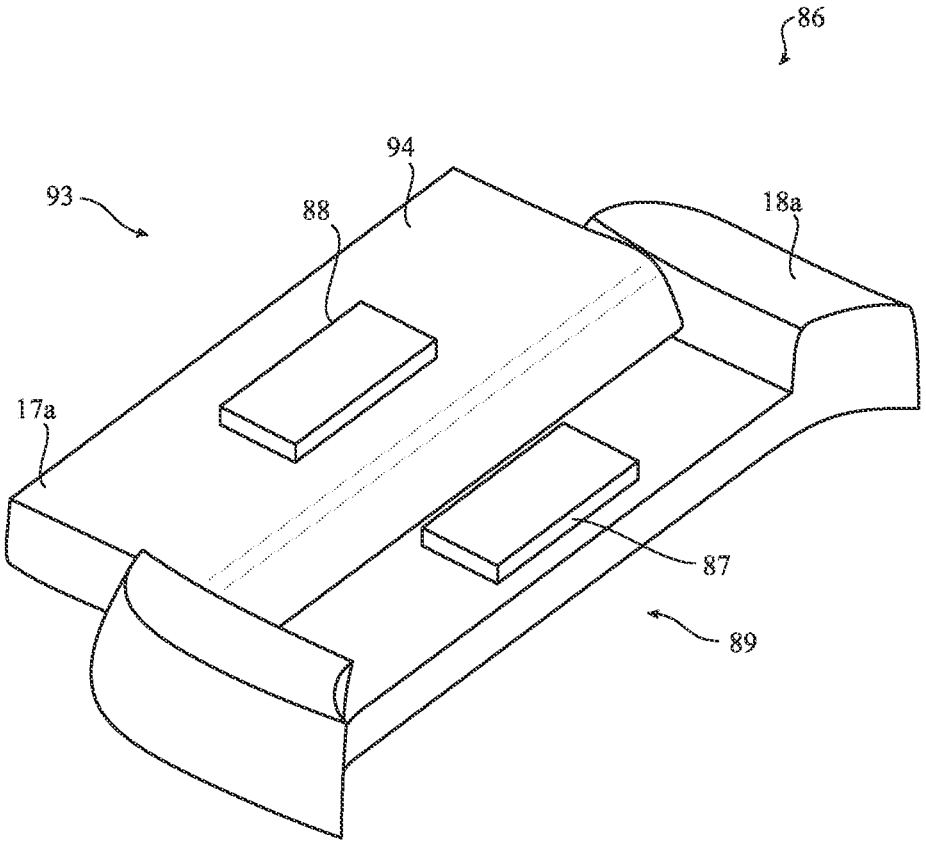
FIG. 14 is a view of a fixed link segment.

FIG. 14 shows a fixed link 86. As discussed above, removable links may be added or removed by a user but certain fixed links 86 may be attached to the electronic device 11 (or a non-electronic device) or to clasp 16. Fixed link 86 includes an inner portion 17*a* and an outer portion 18*a*. Portions 17*a* and 18*a* are similar to inner portion 17 and outer portion 18 as discussed previously except that portions 17*a* and 18*a* are not separable. In one embodiment, portions 17*a* and 18*a* may be welded to an adjacent portion. That is, an inner portion 17*a* could be laser welded to an outer portion 18*a* on an adjacent link 86. While this may be suitable in some embodiments, it may not be aesthetically pleasing to some users and the strength of the laser weld may not be as strong as desired. As with the removable link segments 14, inner portion 17*a* is articulately connected by pin 19 to outer portion 18*a* to provide flexibility as was described. Outer link portion 18*a* includes engagement platform 87 and inner portion 17*a* includes an engagement recess 88.

Figure 15:
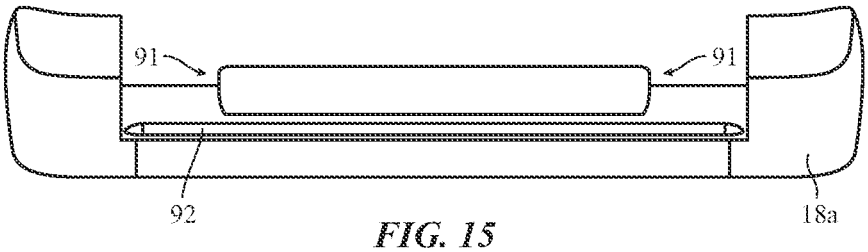
FIG. 15 is a side view of outer link portion of a fixed link segment.

FIG. 15 illustrates a side view of outer link 18*a* as seen from the direction of arrow 93 in FIG. 14. Outer link portion 18*a* includes engagement platform 87. Platform 87 is raised above the surface of link portion 18*a* and includes angled side edges 91. Outer link 18*a* also includes a lip portion 92.

Figure 16:
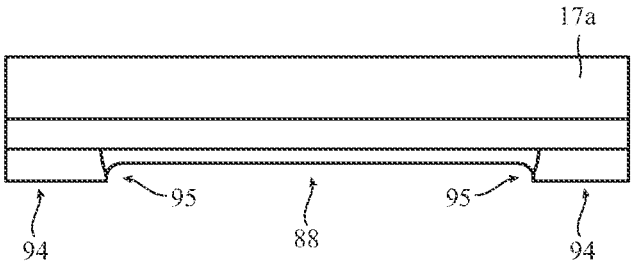
FIG. 16 is a side view of an inner link portion of a fixed link segment.

FIG. 16 is a side view of inner portion 17*a* as seen from the direction of arrow 93 in FIG. 14. Inner link 17*a* includes recess 88 and retention portions 94. Retention portions 94 include angled edges 95 which are engageable with angled side edges 91 on outer link 18*a*. In one embodiment, a portion of recess 88 extends behind retention portions 94.

Figure 17:
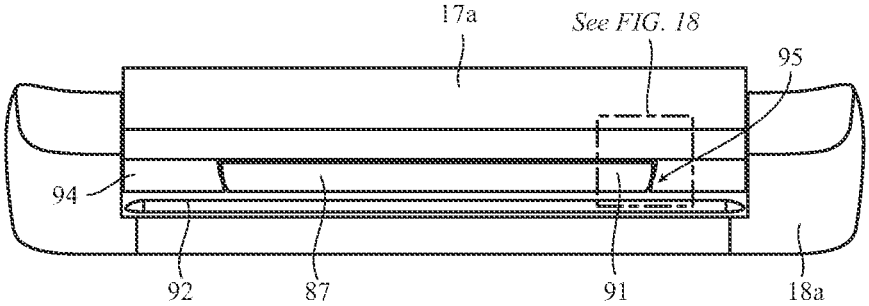
FIG. 17 is a side view of inner portion of a fixed link segment engaged with an outer portion of a fixed link segment.

Referring to FIG. 17 a side view of inner portion 17*a* engaged with outer portion 18*a* is shown. Angled side edges 95 of inner link 17*a* engage with angled side edges 91 of outer link portion 18*a*. That is, inner link portion 17*a* from an adjacent fixed link 86 may slide over engagement platform 87 such that retention portions 94 engage lip portion 92 to fixedly attach adjacent links 86. In one embodiment, inner link portion 17*a* may be spot welded to engagement platform 87 at edges 91/95 to fixedly attach inner link portion 17*a* to outer link portion 18*a* of an adjacent link.

Figure 18:
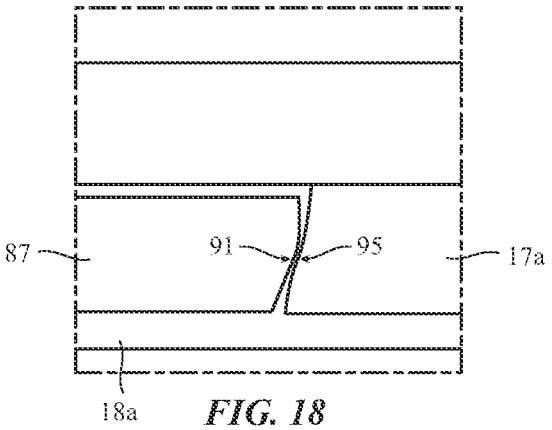
FIG. 18 is a close up view a portion of FIG. 21 illustrating the engagement of the angled side edges of inner link portion with the angled side edges of an outer link portion.

FIG. 18, is a close up view of the engagement of angled side edges 95 of inner link 17*a* engage with angled side edges 91 of outer link portion 18*a*. In one embodiment, a spot weld may be made where angled side edges 91 engage with angled side edges 95 to affix fixed segments and restrain movement of inner link 17*a* with outer link 18*a* of an adjacent segment in the directions of arrows 89 and 93.

Figure 19:
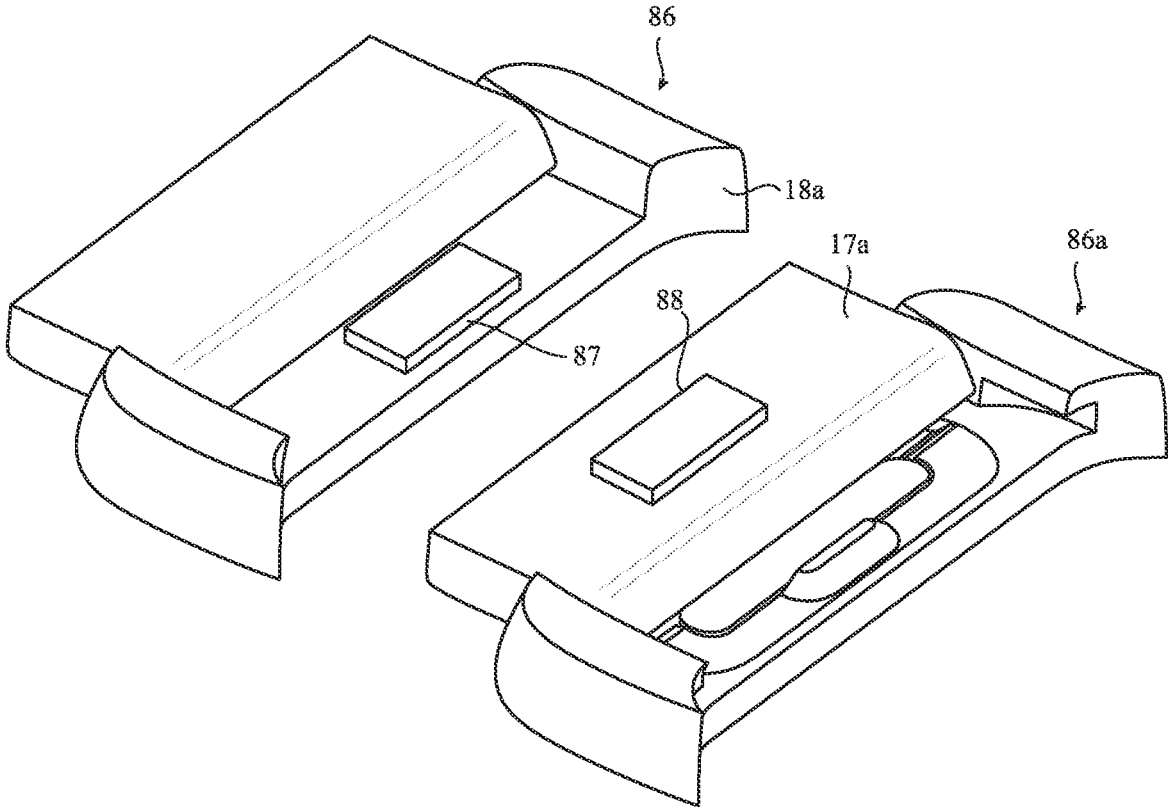
FIG. 19 is a view of fixed link segment and a second fixed link segment which is engageable with a removable segment.

FIG. 19 shows a view of fixed link portion 86 and fixed link portion 86A. Fixed link portion 86A includes inner portion 17*a* as described above in FIGS. 14-17 and also includes outer portion 18 as described above in FIGS. 3-5. That is, inner portion 17*a* of link portion 86A may be fixedly engaged with outer link portion 18*a* of link 86 as described above and an inner link portion 17 from a removable link segment 14 may be removably attached to outer link portion 18 in link 86A as described above with respect to FIGS. 3-5. Thus the fixed link section of wristband 13 may be connected with a removable segment in an adjustable section of wristband 13.

Figure 20:
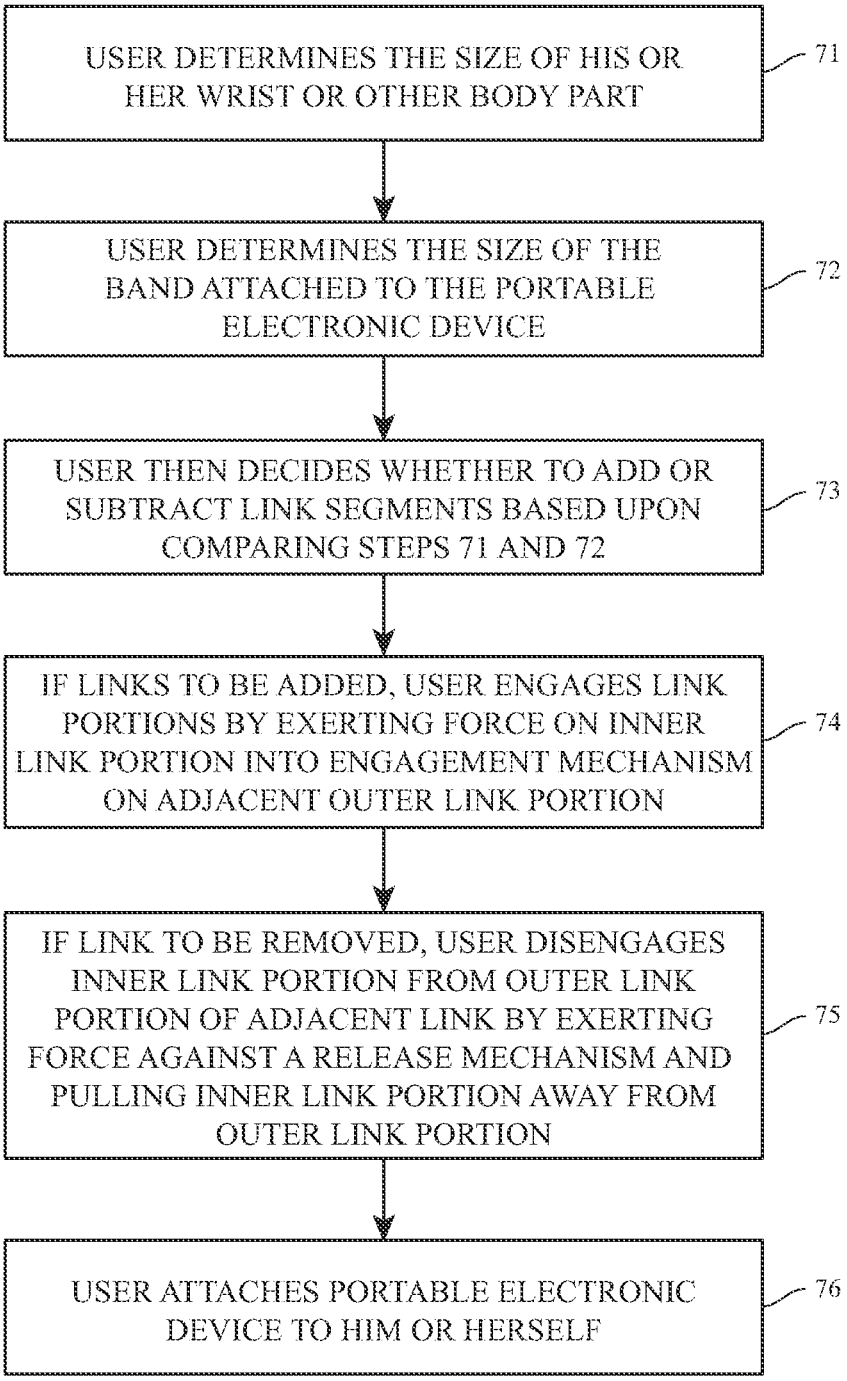
FIG. 20 is a flow chart illustrating a method for attaching a portable electronic device to a user.

FIG. 20 is a flow chart illustrating a method for attaching a portable electronic device to the person of a user. It should be appreciate that the flow chart presumes the band has already been split apart; that is, the flow chart presumes that two adjacent link segments 14 have been decoupled. In operation 71, a user determines the size of his or her wrist or other body part to which the portable electronic device is to be attached. At operation 72, a user determines the size of the band which is attached to the portable electronic device. Based upon a comparison of the sizes determined in operations 71 and 72, the user then decides whether to add or subtract link segments in operation 73. In the event that the band was not split prior to beginning this method, it may be useful to decouple two adjacent link segments 14 after operation 73 in order to permit the addition or removal of link segments.

Link segments 14 are to be added, in operation 74 a user engages an inner link portion 17 of one link with an outer link portion 18 of another link 14*a* by exerting force on the inner link portion 17 by pushing it into an engagement mechanism 26 on the adjacent outer link portion 18 of an adjacent link segment 14 to secure inner link portion 17 in the adjacent outer link portion 18 along an x, y, and z axis. If a link is to be removed, in operation 75 the user disengages inner link portion 17 from outer link portion 18 of adjacent link 14 by exerting force against a release mechanism as described in various embodiments above and pulling inner link portion 17 away from outer link portion 18. As discussed herein, the release mechanism may be a button or, in an alternate embodiment, a tool may be inserted into a hole or another release mechanism such as a rotatably mounted portion on inner portion 17 or spring loaded pin 62 may be employed. After completing operations 71-75, in operation 76 the user may attach the portable electronic device to him or herself using clasp 16 or other suitable closing mechanisms.

Employing the wristband 13 as described herein allows a user to securely attach a portable electronic device to his or her person while maintaining convenience and an aesthetically pleasing look. Buttons 23 on inner portion 17 are preferably turned inwardly toward wrist 12 of a user so as not to be seen. That is buttons 23 are adjacent to the skin of user and, in addition to making wristband 13 more aesthetically pleasing, this orientation of buttons 23 provides additional safety as inadvertent force applied to buttons 23 from exterior sources is avoided. Similarly, clasp 16, due to its unique nesting operation, may provide additional safety features not found in existing clasps. In one embodiment, wristband 13 includes some segments that include release mechanism 26 and some that do not include such mechanism. Segments 14 closest to electronic device 11 may not include release mechanism 26 as there may be no need to detach those segments 14 from wristband 13 adjacent to electronic device 11. Alternatively, these segments could include an alternate engaging mechanism such as pins 62 while segments 14 further away from electronic device 11 may include mechanism 26 so as to make wristband 13 adjustable in size to the wrist 12 of a user. Such sizing may be done by the user him or herself without the need to visit a store or other establishment or to have an expert such as a jeweler to size the wrist band. In addition to being more cost effective, this feature is especially important to individuals who order the portable electronic device over the internet and, for convenience or personal preference reasons, do not wish to visit a "bricks and mortar" type of establishment.

As stated above, link segments 14 or portions of clasp 16 may be curvilinear, complex rounded or other geometries which may be difficult to achieve by conventional manufacturing methods. Typically, machining of parts may be done with a ball end mill. However, for complex geometries, use of a ball end mill may be very time consuming and expensive, requiring 4-axis tilting of the part or tool and a large number of passes of the tool by the part. Modern machining methods employ vertical machining centers. In the vertical mill the spindle axis is vertically oriented. Milling cutters are held in the spindle and rotate on its axis. The spindle can generally be extended (or the table can be raised/lowered, giving the same effect), allowing plunge cuts and drilling.

Figure 21:
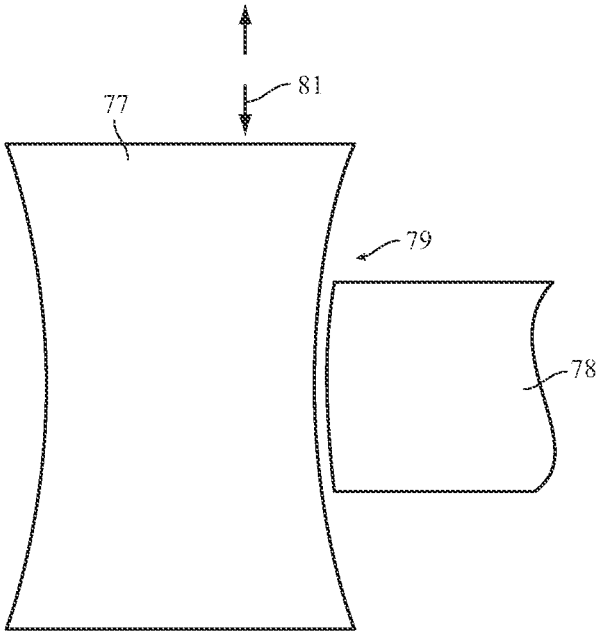
FIG. 21 shows a manufacturing device.

Referring to FIG. 21, a manufacturing device for machining various portions of segments 14 and/or clasp 16 is shown. A milling cutter 77 may be attached to a standard spindle in a vertical milling machine. A part 78 to be machined for segment 14 or clasp 16 is shown adjacent milling cutter 77. Milling cutter 77 includes a curvilinear surface 79 which may include a constant radius curvature or a varying radius curvature. The milling cutter 77 may cut a planar profile (e.g., in the X and Y directions as shown in FIG. 25) for the link. Further, milling cutter 77 is moved up and down in the z-direction as shown by arrows 81 which allows different portions of curvilinear surface to contact part 78 resulting in surfaces of varying surface geometry to be formed on part 78. By varying the portion of curvilinear surface 79 which contacts part 78, complex geometric surfaces associated with segments 14 and clasp 16 may be produced on part 78.

Figure 22:
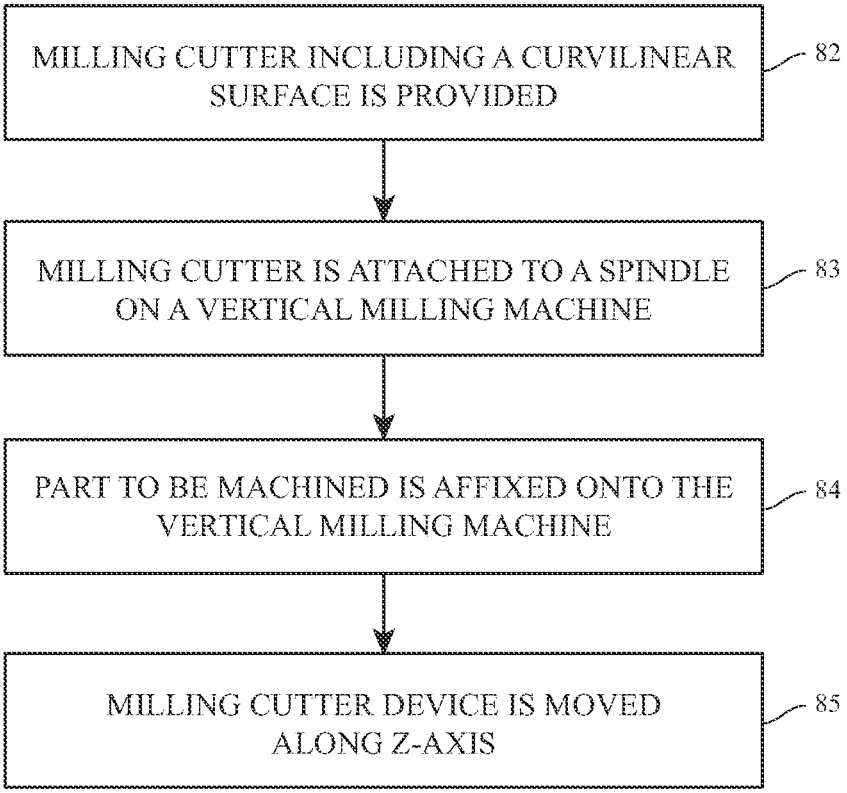
FIG. 22 is a flow chart illustrating a manufacturing method.

FIG. 22 is a flow chart illustrating a sample method for manufacturing a part using the milling cutter device 77 described in FIG. 21. In operation 82, a milling cutter including a curvilinear surface is provided. In operation 83, the milling cutter is attached to a spindle on a vertical milling machine. In operation 84, a part to be machined is affixed onto the vertical milling machine. In operation 85, the milling cutter device 77 is moved along a z-axis to allow different portions of the curvilinear surface of the milling cutter to contact the part and form various curvilinear surfaces on different portions of the part.

In some embodiments, a wristband may be formed from both quick-release link segments and non-quick-release link segments ("non-articulating segments"). The non-articulating segments may be fixed to one another such that they cannot decouple from one another. A first end link in a series of non-articulating segments may connect to an attachment structure that may, in turn, connect the wristband to a consumer product (which may be an electronic or non-electronic device). Alternately, the first end link may connect directly to the consumer product. A second end link may be configured to connect to a quick-release link segment, thereby forming a band having some releasable links and some non-releasable links. Further, the non-articulating segments may appear identical to the quick-release link segments and may include a cosmetic split that mimics the look of the joinder of inner and outer link portions. In some embodiments, this cosmetic split may be omitted.

Further, in some embodiments the widths of the links (both quick-release and non-articulating) may subtly increase across at least a portion of the length of the band. The width of the links may increase from link to link in small increments that may be imperceptible to the human eye when two adjacent links are compared to one another, but visible when multiple connected links are looked at as a group. In this fashion, the width of the band may be subtly adjusted from the clasp to an attachment mechanism that connects the band to a consumer product.

The foregoing description, for purposes of explanation, used specific nomenclature to provide a thorough understanding of the described embodiments. However, it will be apparent to one skilled in the art that the specific details are not required in order to practice the described embodiments.

Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A wristband to secure a portable electronic device to a user comprising:

a first link comprising:

a first outer portion comprising an engagement mechanism; and a first inner portion articulately connected to the first outer portion; and a second link comprising:

a second outer portion; and a second inner portion being articulately connected to the second outer portion, being configured to be received by the engagement mechanism of the first outer portion, and comprising a release mechanism to disengage the engagement mechanism of the first outer portion.

2. The wristband of claim 1, wherein the first outer portion of the first link is identical to the second outer portion of the second link.

3. The wristband of claim 1, wherein the first inner portion of the first link is identical to the second inner portion of the second link.

4. The wristband of claim 1, wherein each of the first link and the second link includes an outer surface for facing away from the user and an inner surface for being positioned adjacent to the user.

5. The wristband of claim 4, wherein the release mechanism includes a button on the inner surface of the second link.

6. The wristband of claim 5, wherein the engagement mechanism includes a resilient spring-loaded mechanism.

7. The wristband of claim 1, wherein the release mechanism includes an access opening on the second inner portion through which a tool may be inserted to disengage the engagement mechanism.

8. The wristband of claim 1, wherein the wristband is connected to the portable electronic device by one or more non-releasable links.

9. The wristband of claim 1, further including a clasp connected to the first link or the second link.

10. The wristband of claim 1, wherein the engagement mechanism includes:

at least one retractable pin on the second inner portion; and a rotatable screw connected to the retractable pin.

11. A wristband to secure a portable electronic device to a user comprising:

an outer portion of a first link, the outer portion comprising:

an engagement mechanism; and receiving portions on opposing sides of the engagement mechanism; and an inner portion of a second link, the inner portion comprising:

a release mechanism to disengage the engagement mechanism of the outer portion from the inner portion; and wing portions on opposing sides of the inner portion;

wherein, when the wing portions are received within the receiving portions, movement of the outer portion relative to the inner portion is constrained to be along an axis, wherein, when the engagement mechanism engages the inner portion, movement of the outer portion relative to the inner portion along the axis is constrained.

12. The wristband of claim 11, wherein:

the outer portion is a first outer portion;

the first link further comprises a first inner portion being articulately connected to the first outer portion;

the inner portion is a second inner portion; and the second link further comprises a second outer portion being articulately connected to the second inner portion.

13. The wristband of claim 11, further including a clasp connected to the first link or the second link.

14. The wristband of claim 11, wherein the engagement mechanism includes a resilient spring-loaded mechanism.

15. The wristband of claim 14, wherein a button on the inner portion may be used to disengage the resilient spring-loaded mechanism.

16. A wristband to secure a portable electronic device to a user comprising:

an outer portion of a first link, the outer portion comprising a spring-loaded engagement mechanism having a protrusion forming a sloped side and a blunt side;

an inner portion of a second link, the inner portion comprising:

a recess for receiving the protrusion of the spring-loaded engagement mechanism; and a release mechanism to disengage the protrusion from the recess, wherein:

the protrusion is retractable when the outer portion is advanced across the sloped side of the protrusion;

when the protrusion is received within the recess, the blunt side of the protrusion prevents disconnection of the inner portion from the outer portion; and the protrusion is retractable from the recess when the release mechanism is actuated.

17. The wristband of claim 16, wherein:

the outer portion is a first outer portion;

the first link further comprises a first inner portion being articulately connected to the first outer portion;

the inner portion is a second inner portion; and the second link further comprises a second outer portion being articulately connected to the second inner portion.

18. The wristband of claim 16, further including a clasp connected to the first link or the second link.

19. The wristband of claim 16, wherein each of the first link and the second link includes an outer surface for facing away from the user and an inner surface for being positioned adjacent to the user.

20. The wristband of claim 19, wherein the release mechanism includes a button on the inner surface of the second link.

* * * * *